US008049373B2

(12) United States Patent
Ishikawa

(10) Patent No.: US 8,049,373 B2
(45) Date of Patent: Nov. 1, 2011

(54) APPARATUS FOR STABILIZING POWER SUPPLY OF HEATER HOUSING BOX COOLING APPARATUS

(75) Inventor: Kouichi Ishikawa, Aichi (JP)

(73) Assignee: Panasonic Corporation, Osaka (JP)

( * ) Notice: Subject to any disclaimer, the term of this patent is extended or adjusted under 35 U.S.C. 154(b) by 149 days.

(21) Appl. No.: 12/516,254

(22) PCT Filed: Dec. 5, 2006

(86) PCT No.: PCT/JP2006/324192

§ 371 (c)(1),
(2), (4) Date: May 26, 2009

(87) PCT Pub. No.: WO2008/068834

PCT Pub. Date: Jun. 12, 2008

(65) Prior Publication Data

US 2010/0066177 A1 Mar. 18, 2010

(51) Int. Cl.
*H01H 47/00* (2006.01)

(52) U.S. Cl. ..... 307/130; 307/112; 307/116; 307/125; 323/247; 323/305; 323/328; 336/137; 60/786; 60/787; 60/788

(58) Field of Classification Search ..... None
See application file for complete search history.

(56) References Cited

U.S. PATENT DOCUMENTS 2,358,432 A * 9/1944 Wolfner ..... 122/504
4,623,834 A * 11/1986 Klingbiel et al. ..... 323/258
5,369,307 A * 11/1994 Kobayashi ..... 307/125
5,543,669 A * 8/1996 Silberhorn ..... 307/125
6,078,148 A * 6/2000 Hochstein ..... 315/291
6,559,562 B1 * 5/2003 Rostron ..... 307/130
2005/0024027 A1 * 2/2005 McVicar ..... 323/255
2005/0264269 A1 * 12/2005 Fattohi ..... 323/255
2006/0202556 A1 * 9/2006 Tanaka et al. ..... 307/11

FOREIGN PATENT DOCUMENTS

JP 53-094676 U 8/1978

(Continued)

OTHER PUBLICATIONS

JP_03078423_A_H to Hagimori, english abstract, Apr. 3, 1991.*

(Continued)

*Primary Examiner* — Rexford Barnie
*Assistant Examiner* — Justen Fauth
(74) *Attorney, Agent, or Firm* — RatnerPrestia

(57) ABSTRACT

In a cooling system used in cooling of a heater housing box, the present invention presents an apparatus for stabilizing power supply of heater housing box cooling apparatus capable of changing over a plurality of taps provided in the winding of a power transformer before the output voltage exceeds an allowable voltage range when turning on alternating-current power supply. For this purpose, first resistor 1 for elevating slowly the output voltage of the power transformer when turning on the alternating-current power supply is provided at the secondary side of the power transformer, direct-current voltage V1 rectified and smoothed from the output voltage is delayed by the charging time of a first capacitor, and an electronic controller for operating a tap changeover relay for automatically changing over the plurality of taps provided in the power transformer is started before the output voltage exceeds the allowable voltage range.

11 Claims, 16 Drawing Sheets

FOREIGN PATENT DOCUMENTS

| | | | |
|---|---|---|---|
| JP | 57-043209 | A | 3/1982 |
| JP | 57-073713 | U | 5/1982 |
| JP | 60-071925 | U | 5/1985 |
| JP | 61-049570 | A | 3/1986 |
| JP | 61-143213 | U | 9/1986 |
| JP | 61-205232 | U | 12/1986 |
| JP | 62-071382 | A | 4/1987 |
| JP | 01-082682 | U | 6/1989 |
| JP | 02-114856 | A | 4/1990 |
| JP | 03-065048 | A | 3/1991 |
| JP | 04-000178 | U | 1/1992 |
| JP | 04-029562 | A | 1/1992 |
| JP | 04-052812 | A | 2/1992 |
| JP | 04-052813 | A | 2/1992 |
| JP | 04-200276 | A | 7/1992 |
| JP | 05-109172 | A | 4/1993 |
| JP | 5-109172 | A | 4/1993 |
| JP | 06-289944 | A | 10/1994 |
| JP | 08-172771 | A | 7/1996 |
| JP | 9-146646 | A | 6/1997 |
| JP | 10-004677 | A | 1/1998 |
| JP | 11-155135 | A | 6/1999 |
| JP | 11-155135 | A | 6/1999 |
| JP | 2003-273559 | A | 9/2003 |
| JP | 2004-139450 | A | 5/2004 |
| JP | 2004-166357 | A | 6/2004 |
| JP | 2006-98016 | A | 4/2006 |
| JP | 2006-109555 | A | 4/2006 |

OTHER PUBLICATIONS

International Search Report for PCT/JP2006/324192, Feb. 27, 2007

JP Office Action for 2005-298649, Nov. 24, 2010.

* cited by examiner

APPARATUS FOR STABILIZING POWER SUPPLY OF HEATER HOUSING BOX COOLING APPARATUS

This application is a U.S. National Phase Application of PCT International Application PCT/JP2006/324192.

TECHNICAL FIELD

The present invention relates to a box structure installed outdoors having a heating element in its inside, large in quantity of heat generation, for example, a box containing a precision machine having a cooling function even in winter, and having a large influence in its performance and life depending on the temperature, especially an apparatus for stabilizing power supply of heater housing box cooling apparatus.

BACKGROUND ART

Conventionally, this type of apparatus for stabilizing power supply of heater housing box cooling apparatus has been applied not only in the heater housing box cooling apparatus, but also in the type having a plurality of taps provided in a power transformer designed to be changed over by detection of secondary side voltage. For instance, an example of this type of apparatus for stabilizing power supply of heater housing box cooling apparatus is disclosed in patent document 1.

The conventional apparatus for stabilizing power supply of heater housing box cooling apparatus is described below by reference to FIG. 11, FIG. 12, FIG. 13, and FIG. 14.

As shown in FIG. 11 to FIG. 14, heater housing box cooling apparatus 202 for cooling heater housing box 201 includes heat exchanger 203 as a heat exchanger for releasing an internal air to an external air, electronic controller 205 having first microcomputer 204 as a control unit, and direct-current fan motor 206 controlled and driven by electronic controller 205.

Alternating-current power supply 207 supplied from heater housing box 201 into heater housing box cooling apparatus 202 is connected in a primary winding of power transformer 208. Tap changeover relay 209 as 1C contact type relay is provided as a switch element as a tap changeover part for changing over a plurality of taps provided in a secondary winding of this power transformer 208. It is supposed herein that only one intermediate tap is provided.

A normally closed terminal of tap changeover relay 209 is connected to one terminal b of the secondary winding of power transformer 208, and a normally opened terminal of this tap changeover relay 209 is connected to intermediate tap c. A common terminal of tap changeover relay 209, and other terminal a of the secondary winding of power transformer 208 are connected to first diode bridge 210, and full waves are rectified, and smoothed by first capacitor 211, and produced as direct-current voltage V2, which is supplied to direct-current fan motor 206 and electronic controller 205.

In this configuration, from alternating-current voltage E2 applied to power transformer 208 from alternating-current power supply 207, direct-current voltage V2 of about $\sqrt{2}$ times of the output voltage determined by the turn ratio of the primary winding and the secondary winding of power transformer 208 is generated. Direct-current voltage V2 is divided by fourth resistor 212 and fifth resistor 213 as output voltage detectors for detecting the output voltage of power transformer 208, and is applied into analog input terminal AIN of first microcomputer 204. When the voltage of AIN exceeds a first threshold (for example, corresponding to 29 V at the voltage of direct-current voltage V2), immediately first microcomputer 204 commands relay drive circuit 214 to turn on tap changeover relay 209. Relay drive circuit 214 changes over the contact point of tap changeover relay 209 to the normally opened side, and the circuit is changed over in the direction of decreasing the number of turns of the secondary winding of power transformer 208, and the output voltage of the secondary side of power transformer 208 declines along with the turn ratio, and the value of direct-current voltage V2 is also lowered.

Afterwards, due to changes of alternating-current voltage E2 of alternating-current power supply 207 or the like, direct-current voltage V2 is also changed, and when the voltage of AIN becomes lower than a second threshold (for example, corresponding to 20 V at the voltage of direct-current voltage V2), immediately first microcomputer 204 commands relay drive circuit 214 to turn off tap changeover relay 209. Relay drive circuit 214 changes over the contact point of tap changeover relay 209 to the normally closed side, and the circuit is changed over in the direction of increasing the number of turns of the secondary winding of power transformer 208, and the output voltage of the secondary side of power transformer 208 climbs up along with the turn ratio, and the value of direct-current voltage V2 is also raised. In this manner, direct-current voltage V21 varies depending on the change of alternating-current voltage E2 of alternating-current power supply 207, but by operating tap changeover relay 209 depending on the value of direct-current voltage V2, the plurality of taps provided in power transformer 208 can be changed over, and the output voltage, that is, direct-current voltage V2 is controlled within a predetermined allowable voltage range (herein, 20 to 29 V).

The conventional apparatus for stabilizing power supply of heater housing box cooling apparatus is not only applied in the heater housing box cooling apparatus, but also available in a type having a plurality of taps provided in a power transformer for detecting the value of alternating-current voltage of the alternating-current power supply and selecting a proper tap depending on the detected voltage value. Such conventional apparatus for stabilizing power supply is disclosed, for example, in patent document 2.

Such conventional apparatus for stabilizing power supply of heater housing box cooling apparatus is described below by reference to FIG. 15 and FIG. 16.

As shown in FIG. 15 and FIG. 16, automatic changeover circuit 315 is provided between alternating-current power supply 307 to be supplied to heater housing box cooling apparatus 302 and power transformer 308. This automatic changeover circuit 315 detects alternating-current voltage E3 of alternating-current power supply 307, and selects a proper one of the plurality of taps provided in power transformer 308 depending on the detected voltage value, and supplies alternating-current voltage E3 to this tap. It is supposed herein that two intermediate taps are provided.

Automatic changeover circuit 315 is composed of tap selection relays 316*a*, 316*b*, 316*c*, input voltage detector 317 as input alternating-current voltage for detecting alternating-current voltage E3 of alternating-current power supply 307, and relay drive circuit 314. Relay drive circuit 314 selects a proper tap out of the plurality of taps provided in power transformer 308 depending on the voltage value detected by input voltage detector 317, and drives tap selection relays 316*a* to *c* so that the selected one may be connected to alternating-current power supply 307.

The secondary side of power transformer 308 is connected to first diode bridge 310, and full waves are rectified, and smoothed by first capacitor 311, and produced as direct-current voltage V3 of about $\sqrt{2}$ times of the output voltage determined by the turn ratio of the primary winding and the secondary winding of power transformer 308, and it is connected to direct-current fan motor 306 and electronic controller 305. Referring now to FIG. 16, input voltage detector 317 is more specifically described. This is the input alternating-current voltage detector for detecting the voltage value of alternating-current voltage E3 in a wide range from nominal voltage 200 V to 250 V. In input voltage detector 317, voltage transformer 318 is connected to alternating-current power supply 307, and the secondary side output voltage of voltage transformer 318 is rectified and smoothed by second diode bridge 319 and second capacitor 320. This rectified and smoothed direct-current voltage V4 is applied to analog input terminal MN of second microcomputer 321. The power supply of +5 V for driving second microcomputer 321 is created by converting direct-current voltage V4 by means of DC/DC converter 322.

In this configuration, when alternating-current power supply 307 is turned on, second microcomputer 321 commands relay drive circuit 314 so as to control tap selection relay 316*c* to close the contact if direct-current voltage V4 becomes lower than a third threshold (for example, corresponding to 220 V of alternating-current voltage E3), to control tap selection relay 316*b* to close the contact if direct-current voltage V4 becomes higher than the third threshold and lower than a fourth threshold (for example, corresponding to 240 V of alternating-current voltage E3), and to control tap selection relay 316*a* to close the contact if direct-current voltage V4 becomes higher than the fourth threshold.

Depending on this command, relay drive circuit 314 closes any one contact of tap selection relays 316*a*, 316*b*, 316*c*, and creates direct-current voltage V3. Later, depending on the change of alternating-current voltage E3 of alternating-current power supply 307, direct-current voltage V3 and direct-current voltage V4 are changed, and the closing contacts of tap selection relays 316*a*, 316*b*, 316*c* are changed over depending on the circumstances of the third threshold and the fourth threshold, and direct-current voltage V3 is controlled within a predetermined allowable voltage range (herein 20 to 29 V).

Further, if alternating-current voltage E3 of alternating-current power supply 307 exceeds the nominal voltage value due to trouble of the power distribution system or the like, and direct-current voltage V4 becomes an overvoltage exceeding a fifth threshold (for example, corresponding to 275 V of alternating-current voltage E3), all contacts of tap selection relays 316*a*, 316*b*, 316*c* are opened. Power transformer 308 is cut off from alternating-current power supply 307, and it is intended to protect from overvoltage so as not to breakdown heater housing box cooling apparatus 302 due to direct-current voltage V3 exceeding the allowable voltage range.

In such conventional apparatus for stabilizing power supply of heater housing box cooling apparatus for changing over the plurality of taps provided in the power transformer depending on detection of secondary side voltage, when the alternating-current power supply is turned on, in less than a second, an output voltage determined by the turn ratio of the primary winding and the secondary winding of the power transformer is generated. This output voltage is generated before the electronic controller detects the output voltage value and operates to select the tap. Thus, the operation of the tap changeover relay is delayed, and for several seconds at least, the connection is fixed to one of the plurality of taps provided in the power transformer. Therefore, the output voltage determined by the turn ratio of the primary winding and the secondary winding of the power transformer is fixed for several seconds and cannot be controlled, possibly exceeding the allowable voltage range depending on the input value of the alternating-current voltage. It is hence required to control so as not to induce breakage of the direct-current fan motor or the electronic controller connected to the output voltage due to the output voltage of the power transformer exceeding the allowable voltage range.

An easy method of preventing breakage by exceeding the allowable output voltage range is to design in a wider allowable applied voltage of the direct-current fan motor or the electronic controller to be connected. That is, it may be considered to select a component one rank higher in the dielectric strength, or to provide each device with an overvoltage preventive circuit. In these methods, however, the apparatus may be increased in size or raised in cost unnecessarily, and it has been demanded to decrease the size of the apparatus while solving these problems.

When turning on the alternating-current power supply, a large rush current flows as excitation current of the power transformer, and it is necessary to prepare a sufficient power supply capacity of the alternating-power supply. In other words, the facility cannot be used unless the power supply capacity is sufficient, and it is demanded to suppress the excitation current of the power transformer occurring at the time of turning on the alternating-current power supply.

In the conventional apparatus for stabilizing power supply of heater housing box cooling apparatus by detecting the value of the output voltage of the alternating-current power supply, and selecting a proper tap out the plurality of taps provided in the power transformer depending on the detected voltage value, as the input alternating-current voltage detector for detecting the voltage value of the alternating-current voltage, for the overvoltage exceeding the nominal voltage value generate due to trouble of the power distribution system or the like, the input voltage detector itself may be exposed to an overvoltage. It is hence demanded to control so that the input voltage detector may not be broken by overvoltage of the alternating-current power source.

As an easy method of preventing breakage of input voltage detecting device due to overvoltage of the alternating-current power supply, it may be considered to select a component one rank higher in the dielectric strength, or to provide each device with an overvoltage preventive circuit. In these methods, however, the apparatus may be increased in size or raised in cost unnecessarily, and it has been demanded to decrease the size of the apparatus while solving these problems.

Besides, since the since the tap of the power transformer and the alternating-current power supply are connected only when detecting the value of the alternating-current voltage of the alternating-current power supply, in order to execute various operations in the automatic changeover circuit, the power supply cannot be supplied from the output voltage of the power transformer, and it was required to compose a power supply circuit separately inside or outside of the automatic changeover circuit. It has been demanded to decrease the apparatus in size by solving these problems.

At the time of overvoltage of alternating-current power supply, the power feed to the power transformer is cut off, and the electronic controller, which is the core of the cooling apparatus operating by the output voltage of the power transformer, cannot be operated. Accordingly, in the event of overvoltage of alternating-current power supply, it is required to assure power feeding to the electronic controller.

Also at the time of overvoltage of alternating-current power supply, it is impossible to report overvoltage protective operation to outside, and it is required to report overvoltage protective operation to outside in the event of overvoltage of alternating-current power supply.

Patent document 1: Japanese Patent Unexamined Publication No. H5-109172.

Patent document 2: Japanese Patent Unexamined Publication No. H11-155135.

DISCLOSURE OF THE INVENTION

The present invention is devised to solve these conventional problems, and is reduced in the size of the apparatus by controlling the output voltage within an allowable voltage range when turning on the alternating-current power supply. In the event of overvoltage of alternating-current power supply, the output voltage can be controlled within an allowable voltage range, and power feeding to the electronic controller can be continued, and rush current into the alternating-current power supply can be suppressed. Moreover, an apparatus for stabilizing power supply circuit of heater housing box cooling apparatus capable of reporting an overvoltage protective action of the alternating-current power supply to outside can be presented.

The apparatus for stabilizing power supply of heater housing box cooling apparatus of the present invention is an apparatus for stabilizing power supply of heater housing box cooling apparatus for cooling the heater housing box includes a power transformer for transforming the output voltage supplied from the heater housing box, a plurality of taps provided in the winding of the power transformer for controlling the transformed output voltage within an allowable voltage range, a tap changeover part for changing over the plurality of taps, an output voltage detector for detecting the transformed output voltage, and a delay part for limiting the rise of the transformed output voltage when turning on the alternating-current power supply.

By means of the delay part for limiting the rise of the transformed output voltage when turning on the alternating-current power supply, the output voltage can be elevated slowly when turning on the alternating-current power supply. Therefore, the taps of the power transformer can be changed over appropriately before the output voltage exceeds the allowable voltage range, so that the apparatus for stabilizing power supply of heater housing box cooling apparatus may be realized in a small apparatus size.

In other aspect of the present invention, a first resistor as the delay part is provided at the secondary side of the power transformer, and a switch element for lowering the resistance value of this first resistor in ordinary operation after the delay action is connected in parallel.

Accordingly, by elevating the output voltage slowly when turning on the alternating-current power supply, the taps of the power transformer can be changed over appropriately before the output voltage exceeds the allowable voltage range, so that the apparatus for stabilizing power supply of heater housing box cooling apparatus may be realized in a small apparatus size. In ordinary operation after the delay action, the resistance of this first resistor may be eliminated.

In a different aspect of the present invention, a rectifying and smoothing part for rectifying and smoothing the transformed output voltage and producing a direct-current voltage, and a second resistor for dividing the direct-current voltage produced from the rectifying and smoothing part together with the first resistor are provided between the positive pole and the negative pole of the direct-current voltage.

Accordingly, by elevating the output voltage slowly when turning on the alternating-current power supply, the taps of the power transformer can be changed over appropriately before the output voltage exceeds the allowable voltage range, so that the apparatus for stabilizing power supply of heater housing box cooling apparatus may be realized in a small apparatus size.

In a different aspect of the present invention, the first resistor is provided between a rectifying element for composing the output part and the rectifying and smoothing part of the power transformer, and a capacitor.

Accordingly, by elevating the output voltage slowly when turning on the alternating-current power supply, the taps of the power transformer can be changed over appropriately before the output voltage exceeds the allowable voltage range. Besides, since the switch element is provided for shorting the circuit of the rectified and smoothed direct-current voltage, it is easy to drive an electronic device having the negative pole at reference potential, and by using a voltage drive type electronic device, in particular, the driving voltage may be lowered, and the energy is saved, so that the apparatus for stabilizing power supply of heater housing box cooling apparatus may be realized in a small apparatus size.

In a different aspect of the present invention, a first resistor as the delay part is provided at the primary side of the power transformer, and a switch element for lowering the resistance value of this first resistor in ordinary operation after the delay action is connected in parallel.

Accordingly, by elevating the output voltage slowly when turning on the alternating-current power supply, the taps of the power transformer can be changed over appropriately before the output voltage exceeds the allowable voltage range. Still more, the excitation current when turning on the alternating-current power supply can be suppressed, so that the apparatus for stabilizing power supply of heater housing box cooling apparatus may be realized in a small apparatus size. In ordinary operation after the delay action, the resistance of this first resistor may be eliminated.

In a different aspect of the present invention, a third resistor for dividing the alternating-current voltage of the alternating-current power supply together with the first resistor is provided between the power transformer side of the first resistor and the opposite side phase of the phase of the alternating-current power supply connected with the first resistor, that is, the side not connected with the first resistor.

Accordingly, by elevating the output voltage slowly when turning on the alternating-current power supply, the taps of the power transformer can be changed over appropriately before the output voltage exceeds the allowable voltage range. Still more, the excitation current when turning on the alternating-current power supply can be suppressed, so that the apparatus for stabilizing power supply of heater housing box cooling apparatus may be realized in a small apparatus size.

In a different aspect of the present invention, the turn ratio of the primary winding and the secondary winding of the power transformer is set so that the output voltage of the power transformer when turning on the alternating-current power supply may become the starting voltage of the electronic controller connected to the apparatus for stabilizing power supply.

Accordingly, by elevating the output voltage slowly when turning on the alternating-current power supply, the taps of the power transformer can be changed over appropriately before the output voltage exceeds the allowable voltage range. Still more, the excitation current when turning on the alternating-current power supply can be suppressed, so that the apparatus for stabilizing power supply of heater housing box cooling apparatus may be realized in a small apparatus size.

In a different aspect of the present invention, an overvoltage protective action part is provided for turning off the switch element connected in parallel to the first resistor when the output voltage of the alternating-current power supply is larger than a nominal value after turning on the alternating-current power supply.

Accordingly, without requiring the input voltage detector for detecting the alternating-current voltage value of the alternating-current power supply, the output voltage of the power transformer can be controlled within an allowable voltage range, and the apparatus can be protected from an overvoltage. At the same time, during an overvoltage protective action, the power can be supplied continuously into the electronic controller without requiring an extra power supply circuit, and the apparatus for stabilizing power supply of heater housing box cooling apparatus may be realized in a small apparatus size.

In a different aspect of the present invention, a luminous display part is provided for the ease of visual recognition of the overvoltage protective action from outside at the time of operation of the overvoltage protective action.

Accordingly, without requiring the input voltage detector for detecting the alternating-current voltage value of the alternating-current power supply, the overvoltage protective action can be recognized visually by a service man or the like, and the apparatus for stabilizing power supply of heater housing box cooling apparatus may be realized in a small apparatus size.

In a different aspect of the present invention, a second switch element is provided for noticing the overvoltage protective action to outside at the time of operation of the overvoltage protective action.

Accordingly, without requiring the input voltage detector for detecting the alternating-current voltage value of the alternating-current power supply, the overvoltage protective action can be noticed to an operator by remote control, and the apparatus for stabilizing power supply of heater housing box cooling apparatus may be realized in a small apparatus size.

In a different aspect of the present invention, the tap changeover part connected to the plurality of taps provided in the primary winding of the power transformer is operated depending on the output voltage detected by the output voltage detector.

Accordingly, by elevating the output voltage slowly when turning on the alternating-current power supply, the taps of the power transformer can be changed over appropriately before the output voltage exceeds the allowable voltage range, and the apparatus for stabilizing power supply of heater housing box cooling apparatus may be realized in a small apparatus size.

In a different aspect of the present invention, the tap changeover part connected to the plurality of taps provided in the secondary winding of the power transformer is operated depending on the output voltage detected by the output voltage detector.

Accordingly, by elevating the output voltage slowly when turning on the alternating-current power supply, the taps of the power transformer can be changed over appropriately before the output voltage exceeds the allowable voltage range, and the apparatus for stabilizing power supply of heater housing box cooling apparatus may be realized in a small apparatus size In a different aspect of the present invention, the tap changeover part connected to the plurality of taps provided in the primary winding and the secondary winding of the power transformer is operated depending on the output voltage detected by the output voltage detector.

Accordingly, by elevating the output voltage slowly when turning on the alternating-current power supply, the taps of the power transformer can be changed over appropriately before the output voltage exceeds the allowable voltage range, and the apparatus for stabilizing power supply of heater housing box cooling apparatus may be realized in a small apparatus size According to the present invention, the output voltage can be elevated slowly when turning on the alternating-current power supply. Therefore, the taps of the power transformer can be changed over appropriately before the output voltage of the power transformer exceeds the allowable voltage range. Without requiring the input voltage detector for detecting the alternating-current voltage value of the alternating-current power supply, the apparatus can be protected from overvoltage from the alternating-current power supply, and the apparatus for stabilizing power supply of heater housing box cooling apparatus can be presented.

DESCRIPTION OF REFERENCE MARKS

Figure 1:
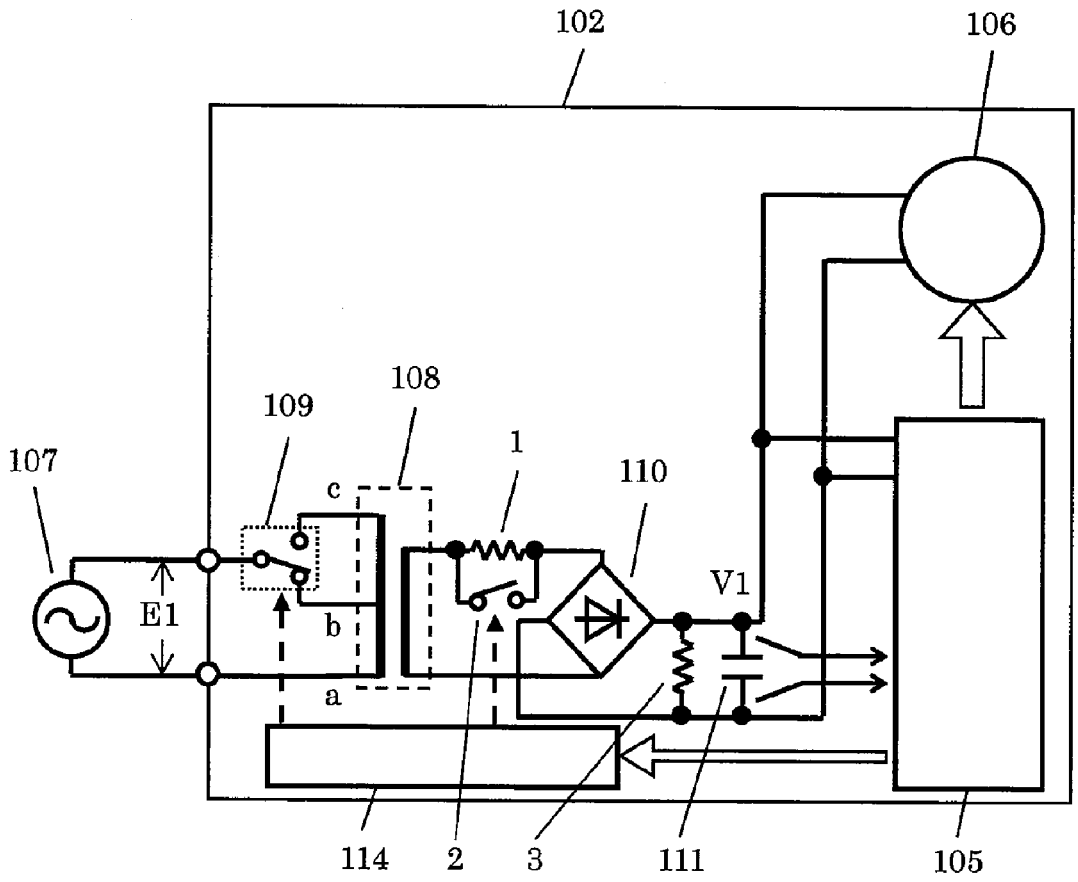
FIG. 1 is a block diagram of configuration of an apparatus for stabilizing power supply of heater housing box cooling apparatus in preferred embodiment 1 of the present invention.

1 First resistor
2 Short-circuit relay
3 Second resistor
4 Field effect transistor
5 Transistor drive circuit
6 Third resistor
7 Starting voltage terminal changeover relay
8 Light-emitting diode
9 Abnormality alarm relay
10 Abnormality alarm signal transmission cable
11 Abnormality alarm signal transmission cable connection terminal block
101 Heater housing box
102 Heater housing box cooling apparatus
103 Heat exchanger
104 First microcomputer
105 Electronic controller
106 Direct-current fan motor
107 Alternating-current power supply
108 Power transformer
109 Tap changeover relay
109*a* First tap changeover relay
109*b* Second tap changeover relay
110 First diode bridge
111 First capacitor
112 Fourth resistor
113 Fifth resistor
114 Relay drive circuit
117 Input voltage detector

PREFERRED EMBODIMENTS FOR CARRYING OUT THE INVENTION

The present invention provides an apparatus for stabilizing power supply of heater housing box cooling apparatus for cooling the heater housing box including a power transformer for transforming the output voltage of alternating-current power supplied from the heater housing box, a plurality of taps provided in the winding of the power transformer for controlling the transformed output voltage within an allowable voltage range, a tap changeover part for changing over the plurality of taps, an output voltage detector for detecting the transformed output voltage, and a delay part for limiting the rise of the transformed output voltage when turning on the alternating-current power supply.

By a first resistor as the delay part for limiting the rise of this output voltage, on the output voltage when turning on the alternating-current power supply, a first capacitor requires a charging time, and as the output voltage, the direct-current voltage can be elevated slowly. Therefore, the electronic controller is started before the output voltage exceeds the allowable voltage range, and the output voltage is detected, and the taps of the power transformer can be changed over appropriately. As a result, the output voltage does not exceed the allowable voltage range.

Herein, the slow elevation is intended to solve the problem, that is, after turning on the alternating-current power supply, reaching voltage V1*a* for starting the output voltage detector, the program of a first microcomputer installed in the output voltage detector starts its execution, and the output voltage is detected, and the output voltage exceeds the allowable voltage range before the tap changeover means starts its action. For example, supposing direct-current voltage V1 as the output voltage to be expressed as function v1(t) of change in time, by resistance R1 of the first resistor and electrostatic capacity C of the first capacitor, by using time constant $\tau 1 = R1 \times C$, the formula $v1(t) = V1 \times \exp\{(-1/\tau 1) \times t\}$ is established. It means that the first capacitor is charged by exponential function, and shows the mode of occurrence of output voltage in consideration of transition of time so that the tap changeover part may start its action in scores of seconds after turning on the alternating-current power supply.

In the present invention, a first resistor as the delay part is provided at the secondary side of the power transformer, and a switch element for lowering the resistance value of the first resistor in ordinary operation after the delay action is connected in parallel.

By using the first resistor on the output voltage when turning on the alternating-current power supply, the first capacitor requires a charging time, and as the output voltage, the direct-current voltage can be elevated slowly. Therefore, the electronic controller is started before the output voltage exceeds the allowable voltage range, and the output voltage is detected, and the taps of the power transformer can be changed over appropriately. As a result, the output voltage does not exceed the allowable voltage range. Besides, in ordinary operation after the delay action, the resistance of the first resistor may be eliminated.

In the present invention, a rectifying and smoothing part for rectifying and smoothing the transformed output voltage and producing a direct-current voltage, and a second resistor for dividing the direct-current voltage produced from the rectifying and smoothing part together with the first resistor are provided between the positive pole and the negative pole of the direct-current voltage.

By using the first resistor on the output voltage when turning on the alternating-current power supply, the first capacitor requires a charging time, and as the output voltage, the direct-current voltage can be elevated slowly. Therefore, the electronic controller is started before the output voltage exceeds the allowable voltage range, and the output voltage is detected, and the taps of the power transformer can be changed over appropriately. As a result, the output voltage does not exceed the allowable voltage range.

In the present invention, the first resistor is provided between a rectifying element for composing the output part and the rectifying and smoothing part of the power transformer, and a capacitor.

By using the first resistor on the output voltage when turning on the alternating-current power supply, the first capacitor requires a charging time, and as the output voltage, the direct-current voltage can be elevated slowly. Therefore, the electronic controller is started before the output voltage exceeds the allowable voltage range, and the output voltage is detected, and the taps of the power transformer can be changed over appropriately. As a result, the output voltage does not exceed the allowable voltage range.

In the present invention, a first resistor as the delay part is provided at the primary side of the power transformer, and a switch element for lowering the resistance of the first resistor in ordinary operation after the delay action is connected in parallel.

By using the first resistor on the output voltage when turning on the alternating-current power supply, the first capacitor requires a charging time, and as the output voltage, the direct-current voltage can be elevated slowly. Therefore, the electronic controller is started before the output voltage exceeds the allowable voltage range, and the output voltage is detected, and the taps of the power transformer can be changed over appropriately. As a result, the output voltage does not exceed the allowable voltage range, and it is effect to suppress the rush current when turning on the alternating-current power supply, that is, the excitation current of the power transformer. Besides, in ordinary operation after the delay action, the resistance of the first resistor may be eliminated.

In the present invention, a third resistor for dividing the alternating-current voltage of the alternating-current power supply together with the first resistor is provided between the power transformer side of the first resistor and the opposite side phase of the phase of the alternating-current power supply connected with the first resistor, that is, the phase not connected with the first resistor.

By using the first resistor on the output voltage when turning on the alternating-current power supply, the first capacitor requires a charging time, and as the output voltage, the direct-current voltage can be elevated slowly. Therefore, the electronic controller is started before the output voltage exceeds the allowable voltage range, and the output voltage is detected, and the taps of the power transformer can be changed over appropriately. As a result, the output voltage does not exceed the allowable voltage range, and it is effect to suppress the rush current when turning on the alternating-current power supply, that is, the excitation current of the power transformer.

In the present invention, the turn ratio of the primary winding and the secondary winding of the power transformer is set so that the output voltage of the power transformer when turning on the alternating-current power supply may become the starting voltage of the electronic controller connected to the apparatus for stabilizing power supply.

The turn ratio of the primary winding and the secondary winding of the power transformer is set so as to lower only the starting voltage of the electronic controller, of the output voltage when turning on the alternating-current power supply. Therefore, the electronic controller is started before the output voltage exceeds the allowable voltage range, and the output voltage is detected, and the taps of the power transformer can be changed over appropriately. As a result, the output voltage does not exceed the allowable voltage range.

In the present invention, an overvoltage protective action part is provided for turning off the switch element connected in parallel to the first resistor when the output voltage of the alternating-current power supply is larger than a nominal value after turning on the alternating-current power supply.

In the event of an overvoltage exceeding the nominal voltage value due to trouble in the power distribution system of the alternating-current power supply or the like, by making use of the voltage drop due to resistance of the first resistor, the output voltage is controlled within the allowable voltage range, and power feeding to the electronic controller can be normalized without requiring an extra power supply.

In the present invention, a luminous display part is provided for the ease of visual recognition of operation of the overvoltage protective action part from outside at the time of operation of the overvoltage protective action part.

Accordingly, the overvoltage protective action in the event of an overvoltage exceeding the nominal voltage due to trouble in the power distribution system of the alternating-current power supply or the like can be recognized visually by lighting up the luminous display means.

In the present invention, a second switch element is provided for noticing operation of the overvoltage protective action part to outside at the time of operation of the overvoltage protective action part.

The overvoltage protective action in the event of an overvoltage exceeding the nominal voltage due to trouble in the power distribution system of the alternating-current power supply or the like can be noticed to an outside device, apparatus or system, by transmitting a signal from the second switch element.

In the present invention, the tap changeover part connected to the plurality of taps provided in the primary winding of the power transformer is operated depending on the output voltage detected by the output voltage detector.

By detecting the output voltage, the taps of the power transformer can be changed over appropriately, the output voltage does not exceed the allowable voltage range.

In the present invention, the tap changeover part connected to the plurality of taps provided in the secondary winding of the power transformer is operated depending on the output voltage detected by the output voltage detector.

By detecting the output voltage, the taps of the power transformer can be changed over appropriately, the output voltage does not exceed the allowable voltage range.

In the present invention, the tap changeover part connected to the plurality of taps provided in the primary winding and the secondary winding of the power transformer is operated depending on the output voltage detected by the output voltage detector.

By detecting the output voltage, the taps of the power transformer can be changed over appropriately, the output voltage does not exceed the allowable voltage range.

Referring now to the drawings, preferred embodiments of the present invention are specifically described below.

Preferred Embodiment 1

Figure 2:
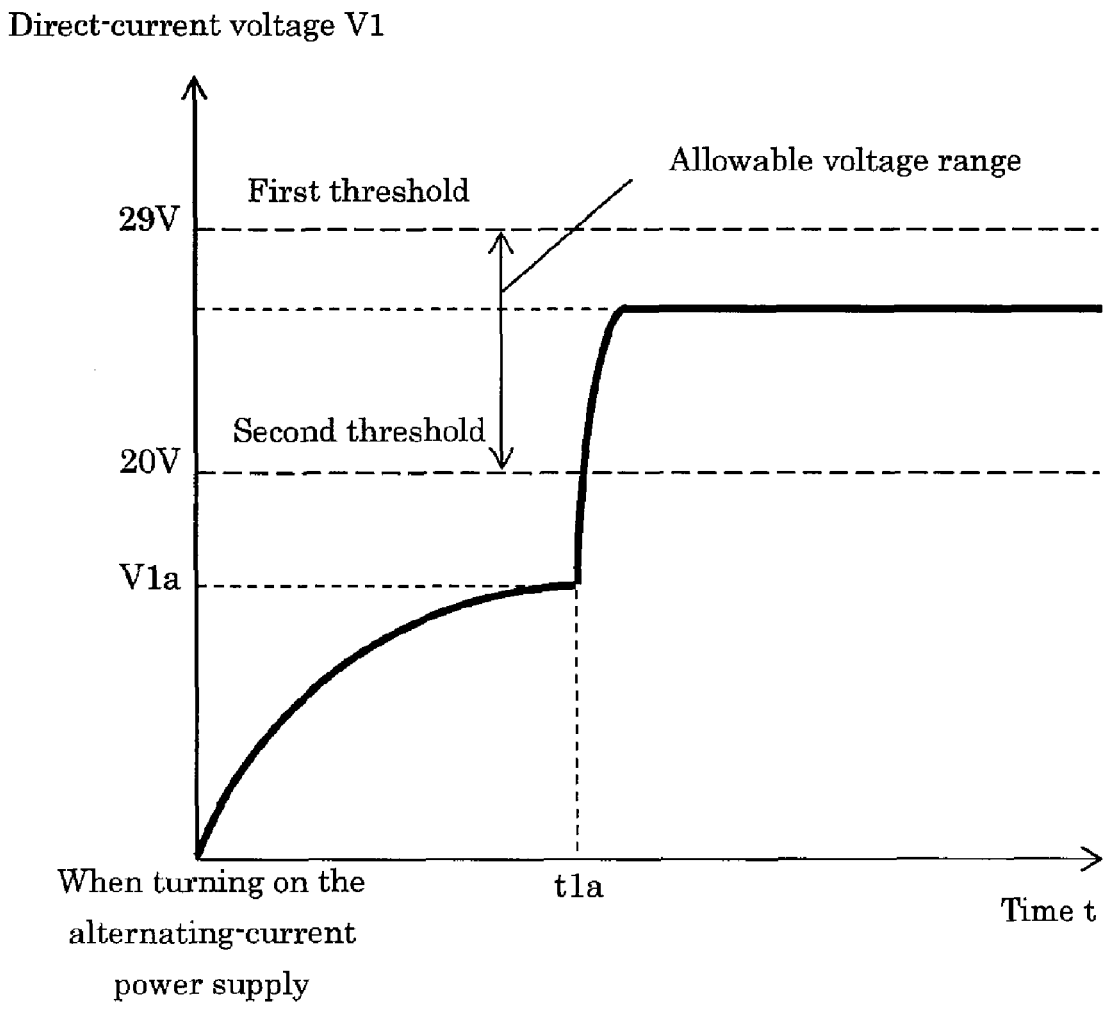
FIG. 2 is a graph showing the transition of time of direct-current voltage V1 of the output voltage when turning on the alternating-current power supply in preferred embodiment 1 of the present invention.
Figure 3:
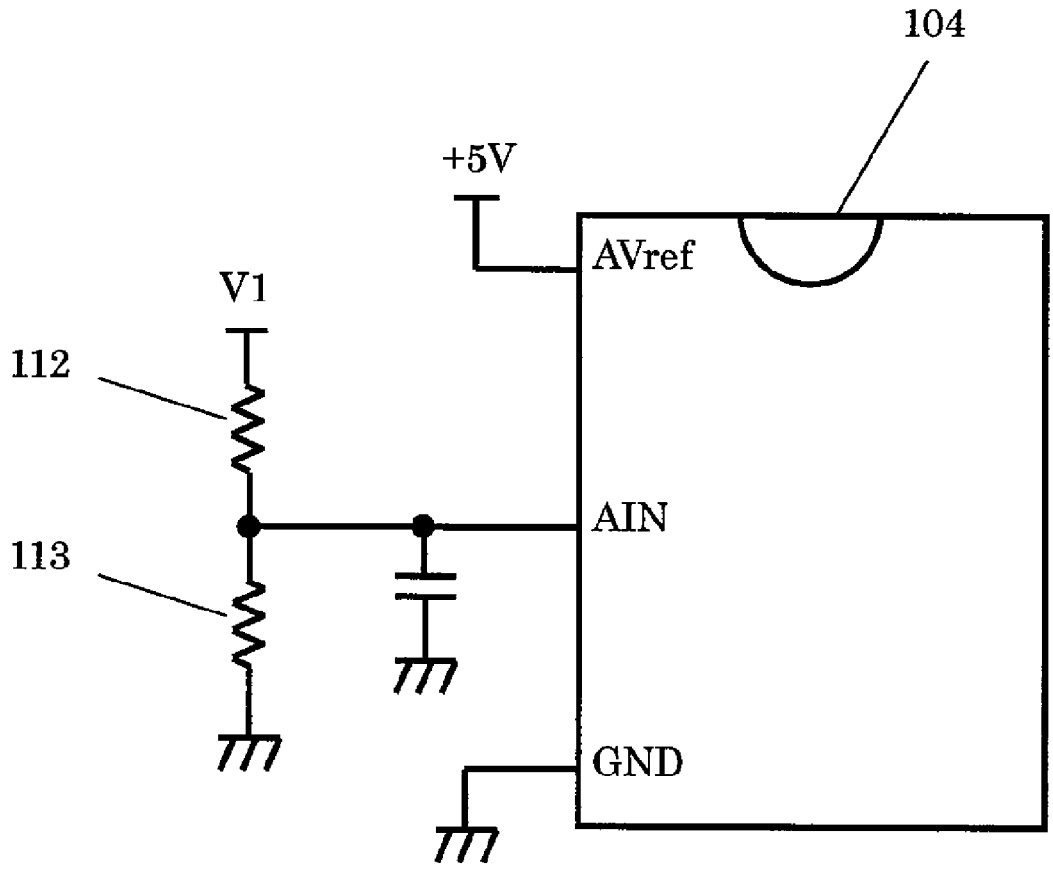
FIG. 3 is a circuit diagram of configuration of an output voltage detector in preferred embodiment 1 of the present invention.

FIG. 1 is a block diagram of configuration of an apparatus for stabilizing power supply of heater housing box cooling apparatus in preferred embodiment 1 of the present invention. FIG. 2 is a graph showing the transition of time of direct-current voltage V1 of the output voltage when turning on the alternating-current power supply in preferred embodiment 1 of the present invention. FIG. 3 is a circuit diagram of configuration of an output voltage detector in preferred embodiment 1 of the present invention.

As shown in FIG. 1, FIG. 2, and FIG. 3, one phase of alternating-current power supply 107 to feed power to heater housing box cooling apparatus 102 is connected to a common terminal of tap changeover relay 109, which is a 1C type contact relay, as a switch element as tap changeover means for changing over a plurality of taps provided in a primary winding of power transformer 108. The normally closed terminal of this tap changeover relay 109 is connected to intermediate tap b of the plurality of taps (herein the intermediate tap is explained to be one) provided in the primary winding of power transformer 108, and the normally opened terminal of tap changeover relay 109 is connected to one terminal c of the primary winding of power transformer 108. Other phase of alternating-current power supply 107 is connected to common terminal a of the primary winding of power transformer 108. The secondary winding of the power transformer 108 is connected to a first diode bridge 110 for rectifying the output voltage in full waves, and between one of the secondary winding of power transformer 108 and first diode bridge 110, first resistor 1 is connected as delay means. In parallel to this first resistor 1, short-circuit relay 2 of 1a contact type is connected as a switch element of short-circuit means. At the output side of first diode bridge 110, first capacitor 111 for smoothing the voltage is provided, and smoothed direct-current voltage V1 is connected to direct-current fan motor 106 and electronic controller 105. In parallel to first capacitor 111, second resistor 3 is connected for dividing the output voltage.

Electronic controller 105 has an output voltage detector shown in FIG. 3, and this output voltage detector has fourth resistor 112, fifth resistor 113, and first microcomputer 104 as the output voltage detector of power transformer 108, and is connected to relay drive circuit 114 for driving tap changeover relay 109 and short-circuit relay 2 by the command from first microcomputer 104.

In this configuration, when turning on alternating-current power supply 107, direct-current voltage V1 is generated by alternating-current voltage E1 applied to power transformer 108. However, since first resistor 1 limits the charging current for charging first capacitor 111 according to time constant $\tau 1$ (=C×R1) of resistance R1 of first resistor 1 and electrostatic capacity C of first capacitor 111, direct-current voltage V1 is elevated slowly along with the lapse of time t.

This voltage value is expressed as diving ratio R2/(R1+R2) of resistance R1 of first resistor 1 and resistance R2 of second resistor 3.

Later, after lapse of time t1*a* (for example, scores of seconds later) when the value of direct-current voltage V1 reaches starting voltage V1*a* of electronic controller 105, first microcomputer 104 starts its action, and direct-current voltage V1 is divided by fourth resistor 112 and fifth resistor 113, and is applied to analog input terminal AIN of first microcomputer 104. First microcomputer 104 commands relay drive circuit 114 to turn on short-circuit relay 2 at least before the voltage of AIN exceeds a second threshold (for example, corresponding to 20 V at voltage of V1). Relay drive circuit 114 closes the contact of short-circuit relay 2 to short-circuit first resistor 1, and immediately charges first capacitor 111 at time constant $\tau 1$ of 0, and elevates direct-current voltage V1 in a fast allowable voltage range at dividing ratio R2/(R1+R2) of 1. After the relay action exceeding the second threshold, an ordinary operation is started control direct-current voltage V1 within an allowable voltage range, and when the voltage of AIN exceeds a first threshold (for example, corresponding to 29 V at voltage of V1), first microcomputer 104 commands relay drive circuit 114 to turn on tap changeover relay 109 immediately. Relay drive circuit 114 changes over the contact of tap changeover relay 109 to the normally opened side, thereby changing over to the circuit for increasing the number of turns of the primary winding of power transformer 108, and the secondary side voltage of power transformer 108 is lowered by the turn ratio.

Afterwards, when direct-current voltage V1 varies due to change in the voltage value of alternating-current voltage E1 of alternating-current power supply 107, and the voltage of AIN becomes lower than the second threshold (for example, corresponding to 20 V at voltage of V1), first microcomputer 104 commands relay drive circuit 114 to turn off tap changeover relay 109 immediately. Relay drive circuit 114 changes over the contact of tap changeover relay 109 to the normally closed side, thereby changing over to the circuit to the tap for decreasing the number of turns of the primary winding of power transformer 108, and the secondary side voltage of power transformer 108 is raised by the turn ratio.

Herein, the slow elevation is intended to solve the problem, that is, after turning on alternating-current power supply 107, reaching voltage V1*a* for starting electronic controller 105, the program of first microcomputer 104 starts its execution, and the output voltage is detected, and the output voltage exceeds the allowable voltage range before transferring to the tap changeover action. For example, as described in the preferred embodiment, supposing direct-current voltage V1 to be expressed as function v1(t) of change in time, by resistance R1 of first resistor 1 and electrostatic capacity C of first capacitor 111, by using time constant $\tau 1$ =R1×C, the formula $v1(t)=V1\times\exp\{(-1/\tau 1)\times t\}$ is established. It means that first capacitor 111 is charged by exponential function, and shows the mode of occurrence of output voltage in consideration of transition of time so that tap changeover relay 109 may start its action in scores of seconds after turning on alternating-current power supply 107.

Herein, if alternating-current voltage E1 of alternating-current power supply 107 exceeds the nominal voltage value due to trouble in the power feeding system or the like, direct-current voltage V1 also rises, and if tap changeover relay 109 is turned on, the voltage of MN may exceed the first threshold. In such a case, as overvoltage protective action means, first microcomputer 104 judges an overvoltage state, and commands relay drive circuit 114 to turn off short-circuit relay 2. Relay drive circuit 114 opens the contact of short-circuit relay 2, and generates diving ratio R2/(R1+R2) of resistance R1 of first resistor 1 and resistance R2 of second resistor 3, thereby lowering the voltage of direct-current value V1 until lower than the first threshold. First microcomputer 104 monitors the voltage of AIN, which is the dividing voltage of direct-current voltage V1, and drives to turn on short-circuit relay 2 before exceeding the second threshold. When exceeding the first threshold, tap changeover relay 109 is driven to turn on until becoming lower than the first threshold, and when becoming lower than the second threshold, tap changeover relay 109 is driven to turn off until exceeding the second threshold. If exceeding the first threshold even by turning off tap changeover relay 109, it is programmed in first microcomputer 104 so as to drive to turn off short-circuit relay 2.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of input voltage value of alternating-current power supply 107, direct-current voltage V1 varies, but tap changeover relay 109 operates according to the value of direct-current voltage V1, and thereby the plurality of taps provided in power transformer 108 are changed over and direct-current voltage V1 is controlled within a predetermined region. Thus, even at the time of overvoltage of alternating-current power supply 107, without cutting off the circuit, the target output voltage, that is, direct-current voltage V1 can be controlled within the predetermined range, and electronic controller 105 continues to operate.

In this preferred embodiment, for the convenience of explanation, one intermediate tap is used in the plurality of taps of the winding of power transformer 108, but two or more may be used. This is common to all other preferred embodiments described below.

Preferred Embodiment 2

Same parts as in preferred embodiment 1 are identified with same reference numerals, and duplicate explanations are omitted.

Figure 4:
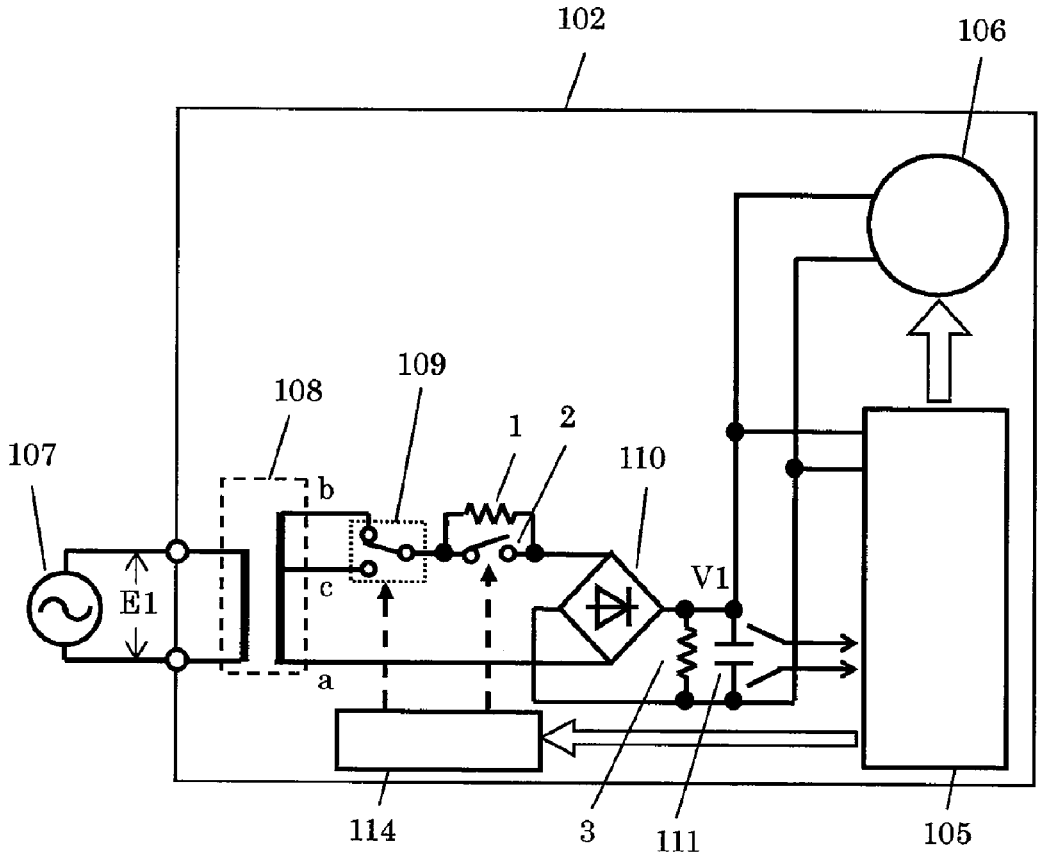
FIG. 4 is a block diagram of configuration of an apparatus for stabilizing power supply of heater housing box cooling apparatus in preferred embodiment 2 of the present invention.

FIG. 4 is a block diagram of configuration of an apparatus for stabilizing power supply of heater housing box cooling apparatus in preferred embodiment 2 of the present invention.

As shown in FIG. 2 and FIG. 4, one phase of alternating-current power supply 107 to be supplied to heater housing box cooling apparatus 102 is connected in the primary winding side of power transformer 108. As a switch element as tap changeover means for changing over the plurality of taps (herein supposing to use one intermediate tap only) provided in the secondary winding of power transformer 108, one terminal b of the secondary winding of power transformer 108 is connected to the normally closed terminal of tap changeover relay 109 of 1C contact type relay. The normally opened terminal of this tap changeover relay 109 is connected to intermediate tap c. The common terminal of tap changeover relay 109 is connected to other terminal a of the secondary winding of power transformer 108 by way of first resistor 1, and is also connected to first diode bridge 110, and full waves are rectified. The output of first diode bridge 110 is smoothed by first capacitor 111, and becomes direct-current voltage V1, and is connected to direct-current fan motor 106 and electronic controller 105. In parallel to first resistor 1, short-circuit relay 2 of 1a contact type is connected, and in parallel to first capacitor 111, second resistor 3 is connected for diving the output voltage.

Electronic controller 105 includes fourth resistor 112 and fifth resistor 113 as output voltage detecting means of power transformer 108, and first microcomputer 104, and relay drive circuit 114 is also connected for driving tap changeover relay 109 and short-circuit relay 2 by the command from first microcomputer 104.

In this configuration, when turning on alternating-current power supply 107, direct-current voltage V1 is generated by alternating-current voltage E1 applied to power transformer 108. However, according to time constant $\tau 1$ (=C×R1) of resistance R1 of first resistor 1 and electrostatic capacity C of first capacitor 111, the charging current for charging first capacitor 111 is limited by first resistor 1, and therefore direct-current voltage V1 is elevated slowly along with lapse of time t.

This voltage value is expressed by dividing ratio R2/(R1+R2) of resistance R1 of first resistor 1 and resistance R2 of second resistor 3.

Later, after lapse of time t1*a* (for example, scores of seconds) when the value of direct-current voltage V1 reaches starting voltage V1*a* of electronic controller 105, first microcomputer 104 starts its operation, and direct-current voltage V1 is divided by fourth resistor 112 and fifth resistor 113, and is applied to analog input terminal AIN of first microcomputer 104. At least before the voltage of AIN exceeds a second threshold (for example, corresponding to 20 V at voltage of V1), first microcomputer 104 commands relay drive circuit 114 to turn on short-circuit relay 2. Relay drive circuit 114 closes the contact of short-circuit relay 2 to short-circuit first resistor 1, and immediately charges first capacitor 111 at time constant $\tau 1$ of 0, and elevates direct-current voltage V1 in a fast allowable voltage range at dividing ratio R2/(R1+R2) of 1. After the end of delay action exceeding the second threshold, the operation is changed to an ordinary action of controlling the direct-current voltage V1 within the allowable voltage range, and when the voltage of AIN exceeds a first threshold (for example, corresponding to 29 V at voltage of V1), first microcomputer 104 commands relay drive circuit 114 to turn on tap changeover relay 109 immediately. Relay drive circuit 114 changes over the contact of tap changeover relay 109 to the normally opened side, so that the circuit is changed over to the side of increasing the number of turns of the primary winding of power transformer 108, and thereby the secondary side voltage of power transformer 108 is lowered by the turn ratio.

Afterwards, when direct-current voltage V1 varies due to change in the voltage value of alternating current voltage E1 of alternating-current power supply 107, and the voltage of AIN becomes lower than the second threshold (for example, corresponding to 20 V at voltage of V1), first microcomputer 104 commands relay drive circuit 114 to turn off tap changeover relay 109 immediately. Relay drive circuit 114 changes over the contact of tap changeover relay 109 to the normally closed side, thereby changing over to the circuit to the tap for decreasing the number of turns of the primary winding of power transformer 108, and the secondary side voltage of power transformer 108 is raised by the turn ratio.

Herein, if alternating-current voltage E1 of alternating-current power supply 107 exceeds the nominal voltage value due to trouble in the power feeding system or the like, direct-current voltage V1 also rises, and if tap changeover relay 109 is turned on, the voltage of AIN may exceed the first threshold. In such a case, as overvoltage protective action means, first microcomputer 104 judges an overvoltage state, and commands relay drive circuit 114 to turn off short-circuit relay 2. Relay drive circuit 114 opens the contact of short-circuit relay 2, and generates diving ratio R2/(R1+R2) of resistance R1 of first resistor 1 and resistance R2 of second resistor 3, thereby lowering the voltage of direct-current value V1 until lower than the first threshold. First microcomputer 104 monitors the voltage of AIN, which is the dividing voltage of direct-current voltage V1, and drives to turn on short-circuit relay 2 before exceeding the second threshold. When exceeding the first threshold, tap changeover relay 109 is driven to turn on until becoming lower than the first threshold, and when becoming lower than the second threshold, tap changeover relay 109 is driven to turn off until exceeding the second threshold. If exceeding the first threshold even by turning on tap changeover relay 109, it is programmed in first microcomputer 104 so as to drive to turn off short-circuit relay 2.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of input voltage value of alternating-current power supply 107, direct-current voltage V1 varies, but tap changeover relay 109 operates according to the value of direct-current voltage V1, and thereby the plurality of taps provided in power transformer 108 are changed over, and direct-current voltage V1, that is, the target output voltage, is controlled within a predetermined region. Thus, even at the time of overvoltage of alternating-current power supply 107, without cutting off the circuit, the target output voltage, that is, direct-current voltage V1 can be controlled within the predetermined range, and electronic controller 105 continues to operate.

Preferred Embodiment 3

Same parts as in preferred embodiment 1 and preferred embodiment 2 are identified with same reference numerals, and duplicate explanations are omitted.

Figure 5:
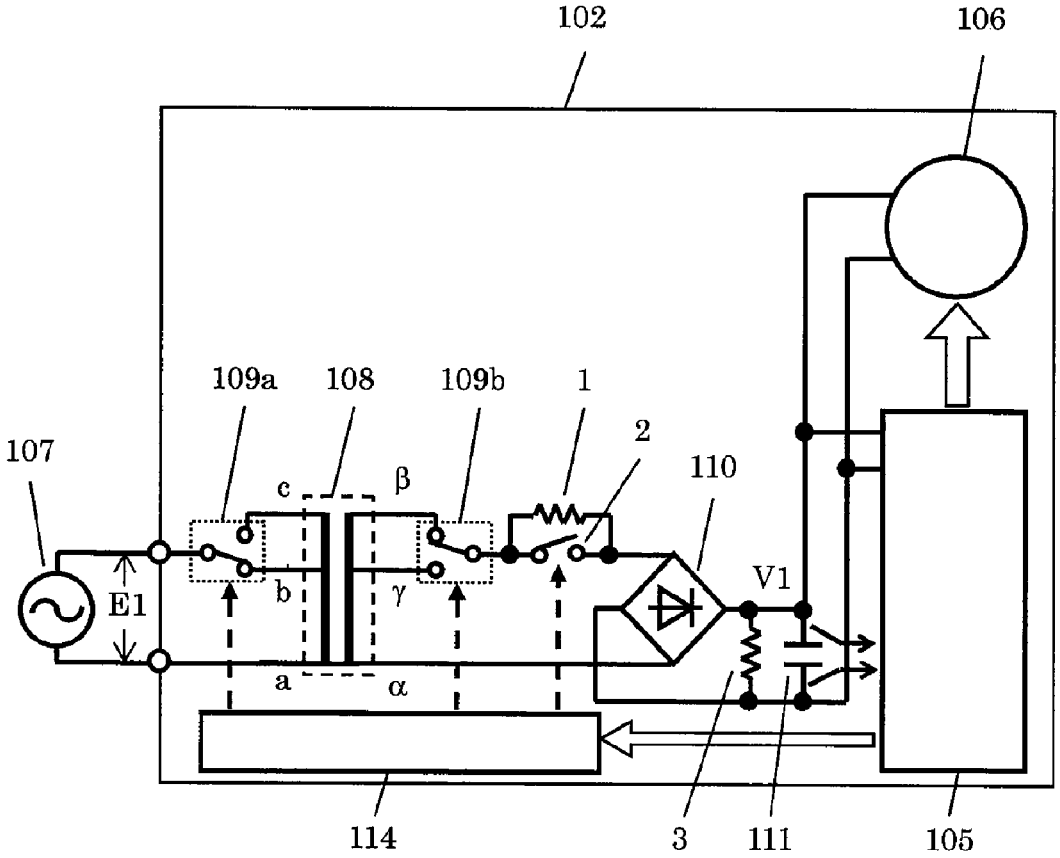
FIG. 5 is a block diagram of configuration of an apparatus for stabilizing power supply of heater housing box cooling apparatus in preferred embodiment 3 of the present invention.

FIG. 5 is a block diagram of configuration of an apparatus for stabilizing power supply of heater housing box cooling apparatus in preferred embodiment 3 of the present invention.

As shown in FIG. 2 and FIG. 5, one phase of alternating-current power supply 107 to be supplied to heater housing box cooling apparatus 102 is connected to the common terminal of first tap changeover relay 109*a* of 1C contact type, as a switch element as tap changeover means for changing over the plurality of taps (herein supposing to use one intermediate tap only) provided in the primary winding of power transformer 108. The normally closed terminal of this first tap changeover relay 109*a* is connected to intermediate tap b provided in the primary winding of power transformer 108, and the normally opened terminal of first tap changeover relay 109*a* is connected to one terminal c provided at the primary winding of power transformer 108, and other phase of alternating-current power supply 107 is connected to common terminal a of the primary winding of power transformer 108. As a switch element as tap changeover means for changing over the plurality of taps (herein supposing to use one intermediate tap only) provided in the secondary winding of power transformer 108, the normally closed terminal of second tap changeover relay 109*b* of 1C contact type is connected to one terminal β provided in the secondary winding of power transformer 108. The normally opened terminal of this second tap changeover relay 109*b* is connected to intermediate tap γ. The common terminal of second tap changeover relay 109*b* is connected to other terminal a of the secondary winding of power transformer 108 by way of first resistor 1, and to first diode bridge 110, and full waves are rectified, direct-current voltage V1 is obtained after being smoothed in first capacitor 111, and is connected to direct-current fan motor 106 and electronic controller 105.

In parallel to first resistor 1, short-circuit relay 2 of 1a contact type is connected, and in parallel to first capacitor 111, second resistor 3 is connected as output voltage dividing means. Electronic controller 105 includes fourth resistor 112 and fifth resistor 113 as output voltage detecting means of power transformer 108, and first microcomputer 104, and relay drive circuit 114 is also connected for driving tap changeover relay 109 and short-circuit relay 2 by the command from first microcomputer 104.

In this configuration, when turning on alternating-current power supply 107, direct-current voltage V1 is generated by alternating-current voltage E1 applied to power transformer 108. However, according to time constant τ1 (=C×R1) of resistance R1 of first resistor 1 and electrostatic capacity C of first capacitor 111, the charging current for charging first capacitor 111 is limited by first resistor 1, and therefore direct-current voltage V1 is elevated slowly along with lapse of time t.

This voltage value is expressed by dividing ratio R2/(R1+R2) of resistance R1 of first resistor 1 and resistance R2 of second resistor 3.

Later, after lapse of time t1*a* (for example, scores of seconds) when the value of direct-current voltage V1 reaches starting voltage V1*a* of electronic controller 105, first microcomputer 104 starts its operation, and direct-current voltage V1 is divided by fourth resistor 112 and fifth resistor 113, and is applied to analog input terminal AIN of first microcomputer 104. At least before the voltage of AIN exceeds a second threshold (for example, corresponding to 20 V at voltage of V1), first microcomputer 104 commands relay drive circuit 114 to turn on short-circuit relay 2. Relay drive circuit 114 closes the contact of short-circuit relay 2 to short-circuit first resistor 1, and immediately charges first capacitor 111 at time constant τ1 of 0, and elevates direct-current voltage V1 in a fast allowable voltage range at dividing ratio R2/(R1+R2) of 1. After the end of delay action exceeding the second threshold, the operation is changed to an ordinary action of controlling the direct-current voltage V1 within the allowable voltage range, and when the voltage of AIN exceeds a first threshold (for example, corresponding to 29 V at voltage of V1), first microcomputer 104 commands relay drive circuit 114 to turn on first tap changeover relay 109*a* immediately. Relay drive circuit 114 changes over the contact of first tap changeover relay 109*a* to the normally opened side, so that the circuit is changed over to the side of increasing the number of turns of the primary winding of power transformer 108, and thereby the secondary side voltage of power transformer 108 is lowered by the turn ratio.

Afterwards, when direct-current voltage V1 varies due to change in the voltage value of alternating-current voltage E1 of alternating-current power supply 107, and the voltage of AIN becomes higher than the first threshold, first microcomputer 104 commands relay drive circuit 114 to turn on second tap changeover relay 109*b* immediately. Relay drive circuit 114 changes over the contact of second tap changeover relay 109*b* to the normally opened side, thereby changing over to the circuit to the tap for decreasing the number of turns of the secondary winding of power transformer 108, and the secondary side voltage of power transformer 108 is lowered by the turn ratio.

Further, when direct-current voltage V1 varies due to change in the voltage value of alternating-current voltage E1 of alternating-current power supply 107, and the voltage of AIN becomes lower than a second threshold (for example, corresponding to 20 V at voltage of V1), first microcomputer 104 commands relay drive circuit 114 to turn off second tap changeover relay 109*b* immediately. Relay drive circuit 114 changes over the contact of second tap changeover relay 109*b* to the normally closed side, thereby changing over to the circuit to the tap for increasing the number of turns of the secondary winding of power transformer 108, and the secondary side voltage of power transformer 108 is raised by the turn ratio.

Herein, alternating-current voltage E1 of alternating-current power supply 107 may exceed the nominal voltage value due to trouble in the power feeding system or the like. In such a case, direct-current voltage V1 also rises, and if first tap changeover relay 109*a* and second tap changeover relay 109*b* are turned on, the voltage of AIN may exceed the first threshold. In such a case, as overvoltage protective action means, first microcomputer 104 judges an overvoltage state, and commands relay drive circuit 114 to turn off short-circuit relay 2. Relay drive circuit 114 opens the contact of short-circuit relay 2, and generates diving ratio R2/(R1+R2) of resistance R1 of first resistor 1 and second resistor 3, thereby lowering the voltage of direct-current value V1 until lower than the first threshold. First microcomputer 104 monitors the voltage of AIN, which is the dividing voltage of direct-current voltage V1, and drives to turn on short-circuit relay 2 before exceeding the second threshold. When exceeding the first threshold, first tap changeover relay 109*a* and second tap changeover relay 109*b* are driven to turn on sequentially until becoming lower than the first threshold. When becoming lower than the second threshold, second tap changeover relay 109*b* and first tap changeover relay 109*a* are sequentially driven to turn off until exceeding the second threshold. If exceeding the first threshold even by turning on first tap changeover relay 109*a* and second tap changeover relay 109*b*, it is programmed in first microcomputer 104 so as to drive to turn off short-circuit relay 2.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of input voltage value of alternating-current power supply 107, direct-current voltage V1 varies, but first tap changeover relay 109*a* and second tap changeover relay 109*b* operate according to the value of direct-current voltage V1, and thereby the plurality of taps provided in power transformer 108 are changed over, and direct-current voltage V1, that is, the target output voltage, is controlled within a predetermined region. Thus, even at the time of overvoltage of alternating-current power supply 107, without cutting off the circuit, the target output voltage, that is, direct-current voltage V1 can be controlled within the predetermined range, and electronic controller 105 continues to operate.

In the preferred embodiment, for the convenience of explanation, among the plurality of taps in the windings of power transformer 108, only one intermediate tap is shown each at the primary side and secondary side, but two or more taps may be used.

Preferred Embodiment 4

Same parts as in preferred embodiment 1 to preferred embodiment 3 are identified with same reference numerals, and duplicate explanations are omitted.

Figure 6:
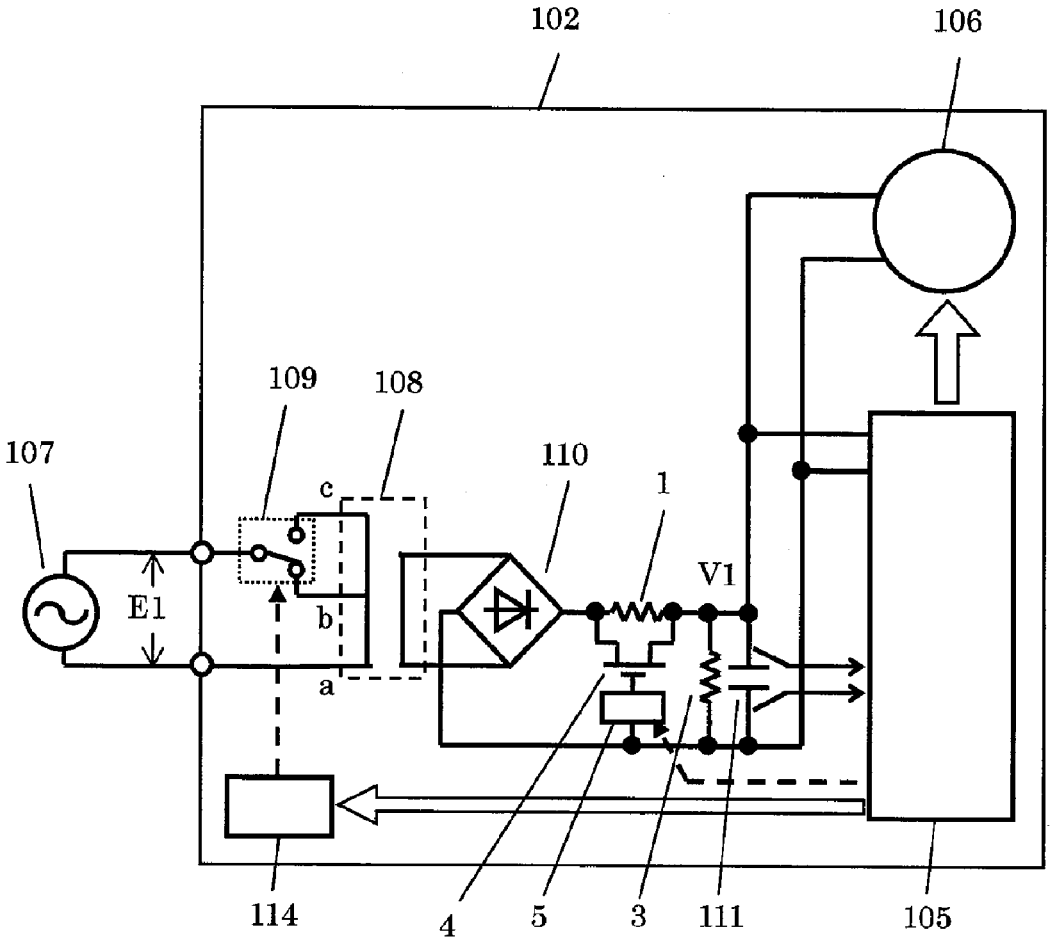
FIG. 6 is a block diagram of configuration of an apparatus for stabilizing power supply of heater housing box cooling apparatus in preferred embodiment 4 of the present invention.

FIG. 6 is a block diagram of configuration of an apparatus for stabilizing power supply of heater housing box cooling apparatus in preferred embodiment 4 of the present invention.

As shown in FIG. 2 and FIG. 6, one phase of alternating-current power supply 107 to be supplied to heater housing box cooling apparatus 102 is connected to the common terminal of tap changeover relay 109 of 1C contact type, as a switch element as tap changeover part for changing over the plurality of taps provided in the primary winding of power transformer 108. The normally closed terminal of this tap changeover relay 109 is connected to intermediate tap b of a plurality of taps (supposing only one intermediate tap is provided herein) provided in the primary winding of power transformer 108, and the normally opened terminal of tap changeover relay 109 is connected to one terminal c provided at the primary winding of power transformer 108. Other phase of alternating-current power supply 107 is connected to common terminal a of the primary winding of power transformer 108. The secondary winding of power transformer 108 is connected to first diode bridge 110 for full-wave rectification of output voltage, and first resistor 1 as delay means is connected between the output side positive pole of first diode bridge 110 and first capacitor 111 for smoothing voltage. In parallel to this first resistor 1, as short-circuit means, field effect transistor 4 is connected as a switch element. Transistor drive circuit 5 is connected between the gate terminal of this field effect transistor 4, and the output side negative pole of first diode bridge 110. As a result, the charging potential of first capacitor 111 becomes direct-current voltage V1, which is connected to direct-current fan motor 106 and electronic controller 105. In parallel to first capacitor 111, second resistor 3 is connected as output voltage dividing means. Electronic controller 105 includes fourth resistor 112 and fifth resistor 113 as output voltage detecting means of power transformer 108, and first microcomputer 104, and relay drive circuit 114 is also connected for driving tap changeover relay 109 and short-circuit relay 2 by the command from first microcomputer 104.

In this configuration, when turning on alternating-current power supply 107, direct-current voltage V1 is generated by alternating-current voltage El applied to power transformer 108. However, according to time constant $\tau 1$ (=C×R1) of resistance R1 of first resistor 1 and electrostatic capacity C of first capacitor 111, the charging current for charging first capacitor 111 is limited by first resistor 1, and therefore direct-current voltage V1 is elevated slowly along with lapse of time t.

This voltage value is expressed by dividing ratio R2/(R1+R2) of resistance R1 of first resistor 1 and resistance R2 of second resistor 3.

Later, after lapse of time t1*a* (for example, scores of seconds) when the value of direct-current voltage V1 reaches starting voltage V1*a* of electronic controller 105, first microcomputer 104 starts its operation, and direct-current voltage V1 is divided by fourth resistor 112 and fifth resistor 113, and is applied to analog input terminal AIN of first microcomputer 104. At least before the voltage of AIN exceeds a second threshold (for example, corresponding to 20 V at voltage of V1), first microcomputer 104 commands transistor drive circuit 5 to turn on field effect transistor 4. Relay drive circuit 114 turns on field effect transistor 4 to short-circuit first resistor 1, and immediately charges first capacitor 111 at time constant $\tau 1$ of 0, and elevates direct-current voltage V1 in a fast allowable voltage range at dividing ratio R2/(R1+R2) of 1. After the end of delay action exceeding the second threshold, the operation is changed to an ordinary action of controlling the direct-current voltage V1 within the allowable voltage range, and when the voltage of AIN exceeds a first threshold (for example, corresponding to 29 V at voltage of V1), first microcomputer 104 commands relay drive circuit 114 to turn on tap changeover relay 109 immediately. Relay drive circuit 114 changes over the contact of tap changeover relay 109 to the normally opened side, so that the circuit is changed over to the side of increasing the number of turns of the primary winding of power transformer 108, and thereby the secondary side voltage of power transformer 108 is lowered by the turn ratio.

Afterwards, when direct-current voltage V1 varies due to change in the voltage value of alternating-current voltage E1 of alternating-current power supply 107, and the voltage of MN becomes lower than a second threshold (for example, corresponding to 20 V at voltage of V1), first microcomputer 104 commands relay drive circuit 114 to turn off tap changeover relay 109 immediately. Relay drive circuit 114 changes over the contact of tap changeover relay 109 to the normally closed side, thereby changing over to the circuit for decreasing the number of turns of the primary winding of power transformer 108, and the secondary side voltage of power transformer 108 is raised by the turn ratio.

Herein, if alternating-current voltage E1 of alternating-current power supply 107 exceeds the nominal voltage value due to trouble in the power feeding system or the like, direct-current voltage V1 also rises, and if tap changeover relay 109 is turned on, the voltage of AIN may exceed the first threshold. In such a case, as overvoltage protective action means, first microcomputer 104 judges an overvoltage state, and commands transistor drive circuit 5 to turn off field effect transistor 4. Transistor drive circuit 5 turns off field effect transistor 4, and generates diving ratio R2/(R1+R2) of resistance R1 of first resistor 1 and second resistor 3, thereby lowering the voltage of direct-current value V1 until lower than the first threshold. First microcomputer 104 monitors the voltage of MN, which is the dividing voltage of direct-current voltage V1, and drives to turn on field effect transistor 4 until exceeding the second threshold. When exceeding the first threshold, tap changeover relay 109 is driven to turn on until lower than the first threshold, and when becoming lower than the second threshold, tap changeover relay 109 is driven to turn off until exceeding the second threshold. If exceeding the first threshold even by turning on tap changeover relay 109, it is programmed in first microcomputer 104 so as to drive to turn off field effect transistor 4.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of output voltage value of alternating-current power supply 107, direct-current voltage V1 varies, but tap changeover relay 109 operates according to the value of direct-current voltage V1, and thereby the plurality of taps provided in power transformer 108 are changed over, and direct-current voltage V1 is controlled within a predetermined region. Thus, even at the time of overvoltage of alternating-current power supply 107, without cutting off the circuit, the target output voltage, that is, direct-current voltage V1 can be controlled within the predetermined range, and electronic controller 105 continues to operate.

In the preferred embodiment, the plurality of taps provided in power transformer 108 are explained as the primary winding, but same as explained in preferred embodiment 2 or preferred embodiment 3, the same action and effect will be obtained if provided in the secondary winding or in both the primary winding and the secondary winding. As the switch element as short-circuit means, field effect transistor 4 is used, but there is not difference in effect or action by using normally-off device such as IGBT or bipolar transistor. The operation of the field effect transistor is explained in a simple ON or OFF operation, but it is also possible to change the charging time of first capacitor 111 by freely changing the apparent resistance of first resistor 1 by turning on and off at high speed characteristic of the semiconductor device.

Preferred Embodiment 5

Same parts as in preferred embodiment 1 to preferred embodiment 4 are identified with same reference numerals, and duplicate explanations are omitted.

Figure 7:
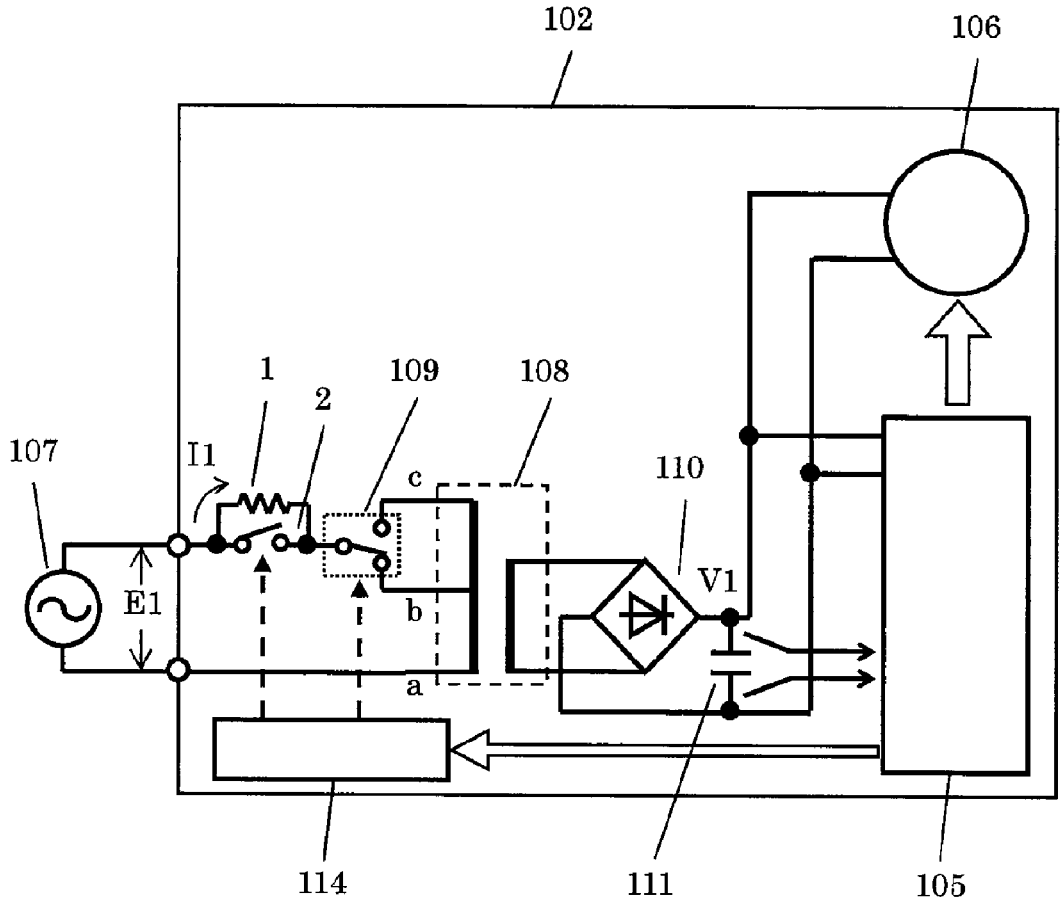
FIG. 7 is a block diagram of configuration of an apparatus for stabilizing power supply of heater housing box cooling apparatus in preferred embodiment 5 of the present invention.

FIG. 7 is a block diagram of configuration of an apparatus for stabilizing power supply of heater housing box cooling apparatus in preferred embodiment 5 of the present invention.

As shown in FIG. 2 and FIG. 7, one phase of alternating-current power supply 107 to be supplied to heater housing box cooling apparatus 102 is connected to the common terminal of tap changeover relay 109 of 1C contact type, as a switch element as tap changeover means for changing over the plurality of taps provided in the primary winding of power transformer 108, by way of first resistor 1 as delay means. The normally closed terminal of this tap changeover relay 109 is connected to intermediate tap b of a plurality of taps (supposing only one intermediate tap is provided herein) provided in the primary winding of power transformer 108. The normally opened terminal of tap changeover relay 109 is connected to one terminal c provided at the primary winding of power transformer 108. Other phase of alternating-current power supply 107 is connected to common terminal a of the primary winding of power transformer 108. In parallel to first resistor 1, as short-circuiting means, short-circuit relay 2 of 1a contact type is connected as a switch element. The secondary side of power transformer 108 is connected to first diode bridge 110, and the voltage is rectified in full waves, and smoothed by first capacitor 111, thereby producing direct-current voltage V1 of about $\sqrt{2}$ times of the output voltage of turn ratio of primary winding of power transformer 108 and secondary winding of power transformer 108, and it is connected to direct-current fan motor 106 and electronic controller 105. Electronic controller 105 includes fourth resistor 112 and fifth resistor 113 as output voltage detecting means of power transformer 108, and first microcomputer 104, and relay drive circuit 114 is also connected for driving tap changeover relay 109 and short-circuit relay 2 by the command from first microcomputer 104.

In this configuration, when turning on alternating-current power supply 107, the excitation current of power transformer 108 is limited by first resistor 1, and the output voltage of the secondary winging of power transformer 108 is elevated more slowly than usual. Direct-current voltage V1 is elevated slowly with the lapse of time t, and after lapse of time t1*a* (for example, scores of seconds) when the value of direct-current voltage V1 reaches starting voltage V1*a* of electronic controller 105, first microcomputer 104 starts its operation. Direct-current voltage V1 is divided by fourth resistor 112 and fifth resistor 113, and is applied to analog input terminal AIN of first microcomputer 104. At least before the voltage of AIN exceeds a second threshold (for example, corresponding to 20 V at voltage of V1), first microcomputer 104 commands relay drive circuit 114 to turn on short-circuit relay 2, and the contact of short-circuit relay 2 is closed to short-circuit first resistor 1. As a result, resistance R1 of first resistor 1 limiting the excitation current of power transformer 108 is invalidated, and an output voltage by the specified turn ratio of the primary winding and the secondary winding is obtained, and at the same time the voltage drop (I1×R1) induced by load current I1 flowing in first resistor 1 is prevented. By this action, after the end of delay action exceeding the second threshold, the operation is changed to an ordinary action of controlling the direct-current voltage V1 within the allowable voltage range. When the voltage of AIN exceeds a first threshold (for example, corresponding to 29 V at voltage of V1), first microcomputer 104 commands relay drive circuit 114 to turn on tap changeover relay 109 immediately, and the contact of tap changeover relay 109 is changed to the normally opened side. As a result, the circuit is changed over to the side of increasing the number of turns of the primary winding of power transformer 108, and thereby the secondary side voltage of power transformer 108 is lowered by the turn ratio. Afterwards, when direct-current voltage V1 varies due to change in the voltage value of alternating-current voltage E1 of alternating-current power supply 107, and the voltage of MN becomes lower than a second threshold (for example, corresponding to 20 V at voltage of V1), first microcomputer 104 commands relay drive circuit 114 to turn off tap changeover relay 109 immediately. Relay drive circuit 109 changes over the contact of tap changeover relay 109 to the normally closed side, thereby changing over to the circuit to the tap for decreasing the number of turns of the primary winding of power transformer 108, and the secondary side voltage of power transformer 108 is raised by the turn ratio.

Herein, if alternating-current voltage E1 of alternating-current power supply 107 exceeds the nominal voltage value due to trouble in the power feeding system or the like, direct-current voltage V1 also rises, and if tap changeover relay 109 is turned on, the voltage of MN may exceed the first threshold. In such a case, as overvoltage protective action means, first microcomputer 104 judges an overvoltage state, and commands relay drive circuit 114 to turn off short-circuit relay 2. Relay drive circuit 114 opens the contact of short-circuit relay 2, and the alternating-current voltage applied to power transformer 108 is lowered by the voltage drop (I1×R1) due to resistance R1 of first resistor 1 and load current I1 flowing in first resistor 1. As a result, since the turn ratio of the primary winding and the secondary winding of power transformer 108 is constant, the output voltage of the power transformer is lowered, and direct-current voltage V1 drops, and becomes lower than the first threshold. First microcomputer 104 monitors the voltage of AIN, which is the dividing voltage of direct-current voltage V1, and drives to turn on short-circuit relay 2 until exceeding the second threshold. When exceeding the first threshold, first microcomputer 104 drives to turn on tap changeover relay 109 until becoming lower than the first threshold, and when becoming lower than the second threshold, tap changeover relay 109 is driven to turn off until exceeding the second threshold. If exceeding the first threshold even by turning on tap changeover relay 109, it is programmed in first microcomputer 104 so as to drive to turn off short-circuit relay 2.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of input voltage value of alternating-current power supply 107, direct-current voltage V1 varies, but tap changeover relay 109 operates according to the value of direct-current voltage V1, and thereby the plurality of taps provided in power transformer 108 are changed over, and direct-current voltage V1 is controlled within a predetermined region. Thus, even at the time of overvoltage of alternating-current power supply 107, without cutting off the circuit, the target output voltage, that is, direct-current voltage V1 can be controlled within the predetermined range, and electronic controller 105 continues to operate.

In the preferred embodiment, the plurality of taps provided in power transformer 108 are explained as the primary winding, but same as explained in preferred embodiment 2 or preferred embodiment 3, the same action and effect will be obtained if provided in the secondary winding or in both the primary winding and the secondary winding.

Preferred Embodiment 6

Same parts as in preferred embodiment 1 to preferred embodiment 5 are identified with same reference numerals, and duplicate explanations are omitted.

Figure 8:
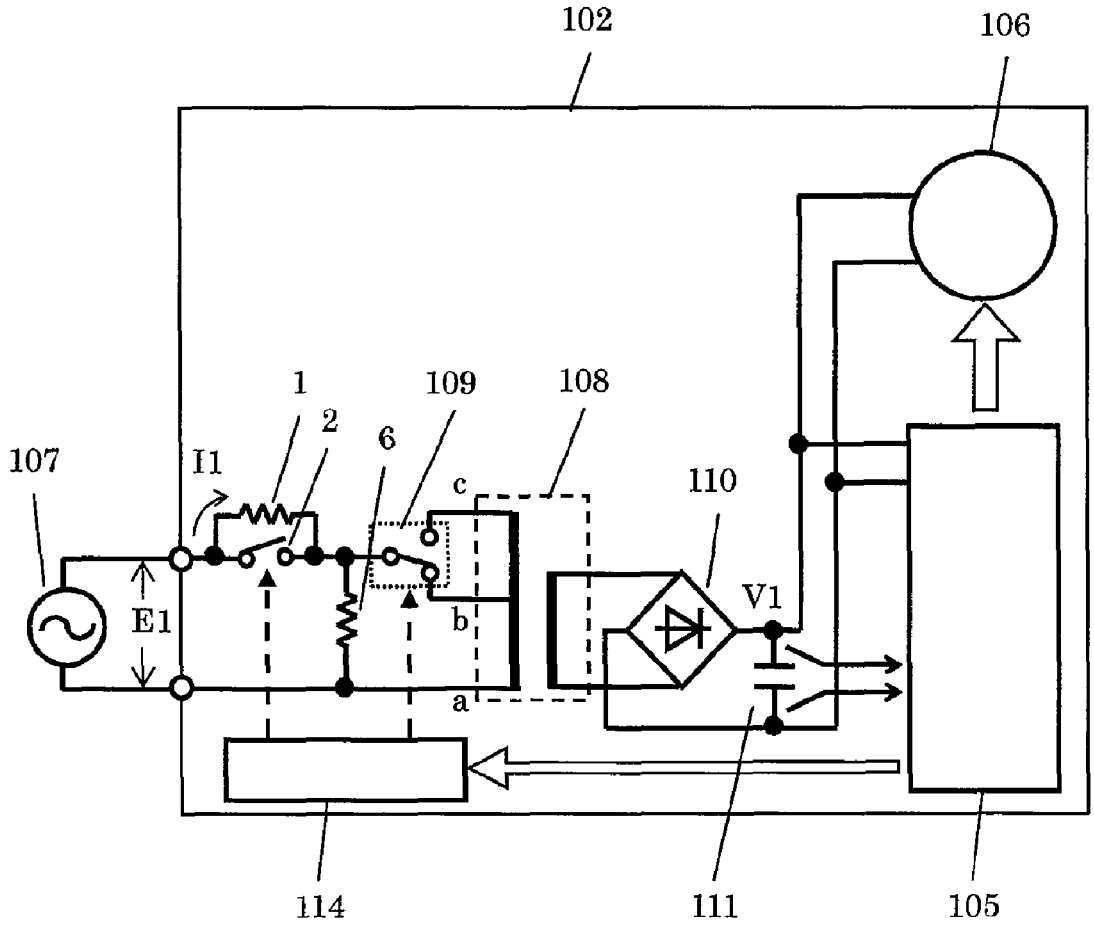
FIG. 8 is a block diagram of configuration of an apparatus for stabilizing power supply of heater housing box cooling apparatus in preferred embodiment 6 of the present invention.

FIG. 8 is a block diagram of configuration of an apparatus for stabilizing power supply of heater housing box cooling apparatus in preferred embodiment 6 of the present invention.

As shown in FIG. 2 and FIG. 8, one phase of alternating-current power supply 107 to be supplied to heater housing box cooling apparatus 102 is connected to the common terminal of tap changeover relay 109 of 1C contact type, as a switch element as tap changeover means for changing over the plurality of taps provided in the primary winding of power transformer 108, by way of first resistor 1 as delay means. The normally closed terminal of this tap changeover relay 109 is connected to intermediate tap b of a plurality of taps (supposing only one intermediate tap is provided herein) provided in the primary winding of power transformer 108. The normally opened terminal of tap changeover relay 109 is connected to one terminal c provided at the primary winding of power transformer 108. Other phase of alternating-current power supply 107 is connected to common terminal a of the primary winding of power transformer 108. In parallel to first resistor 1, as short-circuiting means, short-circuit relay 2 of 1a contact type is connected as a switch element. Between the common terminal of tap changeover relay 109 and common terminal a of the primary winding of power transformer 108, third resistor 6 is connected as alternating-current voltage dividing part. The secondary side of power transformer 108 is connected to first diode bridge 110, and the voltage is rectified in full waves, and smoothed by first capacitor 111, thereby producing direct-current voltage V1 of about $\sqrt{2}$ times of the output voltage of turn ratio of primary winding of power transformer 108 and secondary winding of power transformer 108, and it is connected to direct-current fan motor 106 and electronic controller 105. Electronic controller 105 includes fourth resistor 112 and fifth resistor 113 as output voltage detector of power transformer 108, and first microcomputer 104, and relay drive circuit 114 is also connected for driving tap changeover relay 109 and short-circuit relay 2 by the command from first microcomputer 104.

In this configuration, when turning on alternating-current power supply 107, the excitation current of power transformer 108 is limited by first resistor 1, and the output voltage of the secondary winging of power transformer 108 is elevated more slowly than usual. Alternating-current voltage E1 is divided by dividing ratio R3/(R1+R3) due to resistance R1 of first resistor 1 and resistance R3 of third resistor 6. This divided alternating-current voltage is applied to primary winding common terminal a and intermediate tap b of power transformer 108, and direct-current voltage V1 is elevated slowly with the lapse of time t. After lapse of time t1*a* (for example, scores of seconds) when the value of direct-current voltage V1 reaches starting voltage V1*a* of electronic controller 105, first microcomputer 104 starts its operation, and direct-current voltage V1 is divided by fourth resistor 112 and fifth resistor 113, and is applied to analog input terminal AIN of first microcomputer 104. At least before the voltage of AIN exceeds a second threshold (for example, corresponding to 20 V at voltage of V1), first microcomputer 104 commands relay drive circuit 114 to turn on short-circuit relay 2, and the contact of short-circuit relay 2 is closed to short-circuit first resistor 1. As a result, resistance R1 of first resistor 1 limiting the excitation current of power transformer 108 is invalidated, and an output voltage by the specified turn ratio of the primary winding and the secondary winding is obtained, and at the same time the voltage drop (I1×R1) induced by load current I1 flowing in first resistor 1 is prevented. By this action, after the end of delay action exceeding the second threshold, the operation is changed to an ordinary action of controlling the direct-current voltage V1 within the allowable voltage range, and when the voltage of AIN exceeds a first threshold (for example, corresponding to 29 V at voltage of V1), first microcomputer 104 commands relay drive circuit 114 to turn on tap changeover relay 109 immediately. Relay drive circuit 109 changes the contact of tap changeover relay 109 to the normally opened side, and the circuit is changed over to the side of increasing the number of turns of the primary winding of power transformer 108, and thereby the secondary side voltage of power transformer 108 is lowered by the turn ratio. Afterwards, when direct-current voltage V1 varies due to change in the voltage value of alternating-current voltage E1 of alternating-current power supply 107, and the voltage of MN becomes lower than a second threshold (for example, corresponding to 20 V at voltage of V1), first microcomputer 104 commands relay drive circuit 114 to turn off tap changeover relay 109 immediately. Relay drive circuit 109 changes over the contact of tap changeover relay 109 to the normally closed side, thereby changing over to the circuit to the tap for decreasing the number of turns of the primary winding of power transformer 108, and the secondary side voltage of power transformer 108 is raised by the turn ratio.

Herein, if alternating-current voltage E1 of alternating-current power supply 107 exceeds the nominal voltage value due to trouble in the power feeding system or the like, direct-current voltage V1 also rises, and if tap changeover relay 109 is turned on, the voltage of AIN may exceed the first threshold. In such a case, as overvoltage protective action means, first microcomputer 104 judges an overvoltage state, and commands relay drive circuit 114 to turn off short-circuit relay 2. Relay drive circuit 114 opens the contact of short-circuit relay 2, and alternating-current voltage E1 is decreased by the voltage drop (I1×R1) due to resistance R1 of first resistor 1 and load current I1 flowing in first resistor 1. Alternating-current voltage (E1−(I1×R3))/(R1+R3) divided by dividing ratio R3/(R1+R3) due to resistance R1 of first resistor 1 and resistance R3 of third resistor 6 is applied to primary winding common terminal a and intermediate tap b of power transformer 108, and since the turn ratio of the primary winding and the secondary winding of power transformer 108 is constant, the output voltage of the power transformer 108 is lowered. As a result, direct-current voltage V1 drops, and becomes lower than the first threshold. At this time, if direct-current voltage V1 is lower than the second threshold, first microcomputer 104 decreases load current I1 flowing in first resistor V1, and controls direct-current fan motor 106 to lower the rotating speed of direct-current fan motor 106 or stop its operation, in order to elevate the value of alternating-current voltage (E1−(I1×R3))/(R1+R3) to be applied to primary winding common terminal a and intermediate tap b of power transformer 108. First microcomputer 104 monitors the voltage of AIN, which is the dividing voltage of direct-current voltage V1, and drives to turn on short-circuit relay 2 until exceeding the second threshold, and if exceeding the first threshold even by turning on tap changeover relay 109, short-circuit relay 2 is driven to be turned off. If the voltage of AIN becomes lower than the second threshold, first microcomputer 104 drives to turn off tap changeover relay 109 until exceeding the second threshold, and still lower than the second threshold after this action, it is programmed in first microcomputer 4 so as to lower the rotating speed or stop direct-current fan motor 106.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of input voltage value of alternating-current power supply 107, direct-current voltage V1 varies, but tap changeover relay 109 operates according to the value of direct-current voltage V1, and thereby the plurality of taps provided in power transformer 108 are changed over, and direct-current voltage V1 is controlled within a predetermined range. Thus, even at the time of overvoltage of alternating-current power supply 107, without cutting off the circuit, the target output voltage, that is, direct-current voltage V1 can be controlled within the predetermined range, and electronic controller 105 continues to operate.

In the preferred embodiment, the plurality of taps provided in power transformer 108 are explained as the primary winding, but same as explained in preferred embodiment 2 or preferred embodiment 3, the same action and effect will be obtained if provided in the secondary winding or in both the primary winding and the secondary winding.

Preferred Embodiment 7

Same parts as in preferred embodiment 1 are identified with same reference numerals, and duplicate explanations are omitted.

Figure 9:
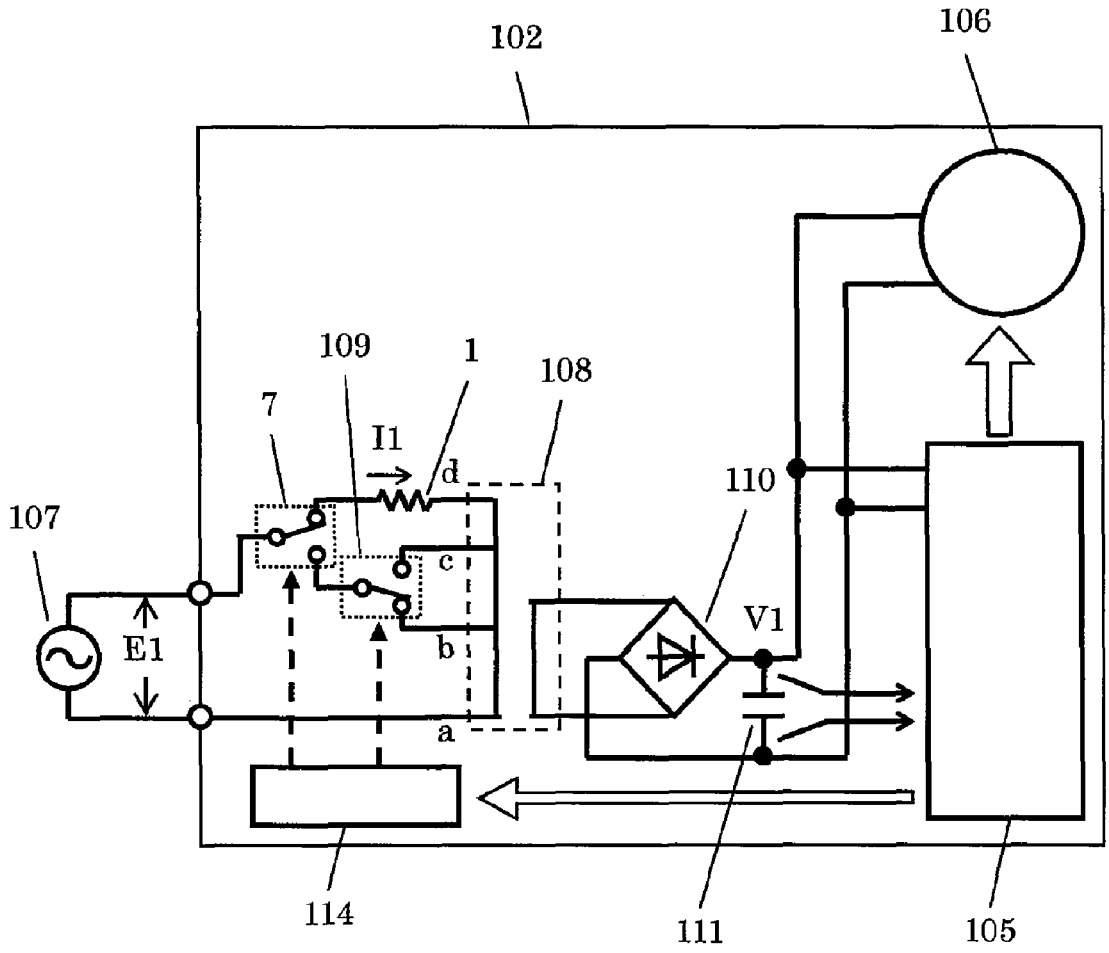
FIG. 9 is a block diagram of configuration of an apparatus for stabilizing power supply of heater housing box cooling apparatus in preferred embodiment 7 of the present invention.

FIG. 9 is a block diagram of configuration of an apparatus for stabilizing power supply of heater housing box cooling apparatus in preferred embodiment 7 of the present invention.

As shown in FIG. 2 and FIG. 9, primary winding common terminal a and other terminal b of power transformer 108 are set so that the output voltage of this power transformer 108 may generate starting voltage V1*a* of electronic controller 105. That is, the turn ratio of the secondary winding between common terminal a and other terminal d of the primary winding is determined so that the output voltage may become starting voltage V1*a* of electronic controller 105 when the lowest value of alternating-current input voltage for operating the heater housing box cooling apparatus is entered. The primary winding of this power transformer 108 is provided with a plurality of taps (two intermediate taps are used herein). One phase of alternating-current power supply 107 to be supplied to heater housing box cooling apparatus 102 is connected to the common terminal of starting voltage terminal changeover relay 7 of 1C contact type relay, as a switch element as tap changeover means. The normally closed terminal of this starting voltage terminal changeover relay 7 is connected to terminal d of power transformer 108 by way of first resistor 1 as delay means. The normally opened terminal of this starting voltage terminal changeover relay 7 is connected to the common terminal of tap changeover relay 109 of 1C contact type relay as switch element as tap changeover means. The normally closed terminal of this tap changeover relay 109 is connected to intermediate tap b of the primary winding of power transformer 108, and the normally opened terminal of tap changeover rely 109 is connected to one terminal c of power transformer 108. Other phase of alternating-current power supply 107 is connected to common terminal a of the primary winding of power transformer 108. The secondary side of power transformer 108 is connected to first diode bridge 110, and the voltage is rectified in full waves, and smoothed by first capacitor 111, thereby producing direct-current voltage V1 of about $\sqrt{2}$ times of the output voltage of turn ratio of primary winding of power transformer 108 and secondary winding of power transformer 108, and it is connected to direct-current fan motor 106 and electronic controller 105. Electronic controller 105 includes fourth resistor 112 and fifth resistor 113 as output voltage detecting means of power transformer 108, and first microcomputer 104, and relay drive circuit 114 is also connected for driving tap changeover relay 109 and short-circuit relay 2 by the command from first microcomputer 104.

In this configuration, when turning on alternating-current power supply 107, the excitation current of power transformer 108 is limited by first resistor 1, and the output voltage of the secondary winging of power transformer 108 is elevated more slowly than usual. Hence, direct-current voltage V1 is elevated slowly with the lapse of time t, and direct-current voltage V1 reaches the starting voltage of electronic controller 105, and electronic controller 105 is operated. After the lapse of time t1*a* (for example, scores of seconds) after reaching starting voltage V1*a* of electronic controller 105, first microcomputer 104 starts its operation. Direct-current voltage V1 is divided by fourth resistor 112 and fifth resistor 113, and is applied to analog input terminal AIN of first microcomputer 104, and at least before the voltage of AIN exceeds a second threshold (for example, corresponding to 20 V at voltage of V1), first microcomputer 104 commands relay drive circuit 114 to turn on starting voltage terminal changeover relay 7. Relay drive circuit 114 changes the contact of starting voltage terminal changeover relay 7 to the normally opened side, and the output voltage is obtained by the specified turn ratio of the primary winding and the secondary winding. By this action, after the delayed action exceeding the second threshold, the operation is change to a normal action of controlling direct-current voltage V1 within an allowable voltage range. If the voltage of AIN exceeds a first threshold (for example, corresponding to 29 V at voltage of V1), first microcomputer 104 command relay drive circuit 114 to turn on tap changeover relay 109 immediately. Relay drive circuit 114 changes the contact of tap changeover relay 109 to the normally opened side, and the circuit is changed over to the side of increasing the number of turns of the primary winding of power transformer 108, and thereby the secondary side voltage of power transformer 108 is lowered by the turn ratio.

Afterwards, when direct-current voltage V1 varies due to change in the voltage value of alternating-current voltage E1 of alternating-current power supply 107, and the voltage of MN becomes lower than a second threshold (for example, corresponding to 20 V at voltage of V1), first microcomputer 104 commands relay drive circuit 114 to turn off tap changeover relay 109 immediately. Relay drive circuit 114 changes over the contact of tap changeover relay 109 to the normally closed side, thereby the circuit is changing over to the tap b for decreasing the number of turns of the primary winding of power transformer 108, and the secondary side voltage of power transformer 108 is raised by the turn ratio.

Herein, if alternating-current voltage E1 of alternating-current power supply 107 exceeds the nominal voltage value due to trouble in the power feeding system or the like, direct-current voltage V1 also rises, and if tap changeover relay 109 is turned on, the voltage of MN may exceed the first threshold. In such a case, as overvoltage protective action means, first microcomputer 104 judges an overvoltage state, and commands relay drive circuit 114 to turn off starting voltage terminal changeover relay 7. Relay drive circuit 114 opens the contact of starting voltage terminal changeover relay 7, and the alternating-current voltage applied to power transformer 108 is lowered by the voltage drop (I1×R1) due to resistance R1 of first resistor 1 and load current I1 flowing in first resistor 1. And since the turn ratio of the primary winding and the secondary winding of power transformer 108 is constant, the output voltage of the power transformer is lowered, and direct-current voltage V1 drops and becomes lower than the first threshold. First microcomputer 104 monitors the voltage of AIN, which is the dividing voltage of direct-current voltage V1, and drives to turn on starting voltage terminal changeover relay 7 until exceeding the second threshold, and if exceeding the first threshold, tap changeover relay 109 is driven to be turned on until becoming lower than the first threshold. If the voltage of AIN becomes lower than the second threshold, first microcomputer 104 drives to turn off tap changeover relay 109 until exceeding the second threshold, and if still higher than the first threshold even by turning on tap changeover relay 109, it is programmed in first microcomputer 104 so as to drive to turn off short-circuit relay 2.

Thus, when turning on alternating-current power supply 107, the output voltage, or direct-current voltage V1 is elevated slowly, and if alternating-current power supply 107 is turned on, the voltage does not exceed the allowable output voltage range (herein, 20 to 29 V). Further, depending on the changes of input voltage value of alternating-current power supply 107, direct-current voltage V1 varies, but tap changeover relay 109 operates according to the value of direct-current voltage V1, and thereby the plurality of taps provided in power transformer 108 are changed over, and direct-current voltage V1 is controlled within a predetermined range. Thus, even at the time of overvoltage of alternating-current power supply 107, without cutting off the circuit, the target output voltage, that is, direct-current voltage V1 can be controlled within the predetermined range, and electronic controller 105 continues to operate.

In the preferred embodiment, the plurality of taps provided in power transformer 108 are explained as the primary winding, but same as explained in preferred embodiment 2 or preferred embodiment 3, the same action and effect will be obtained if provided in the secondary winding or in both the primary winding and the secondary winding.

Preferred Embodiment 8

Figure 10:
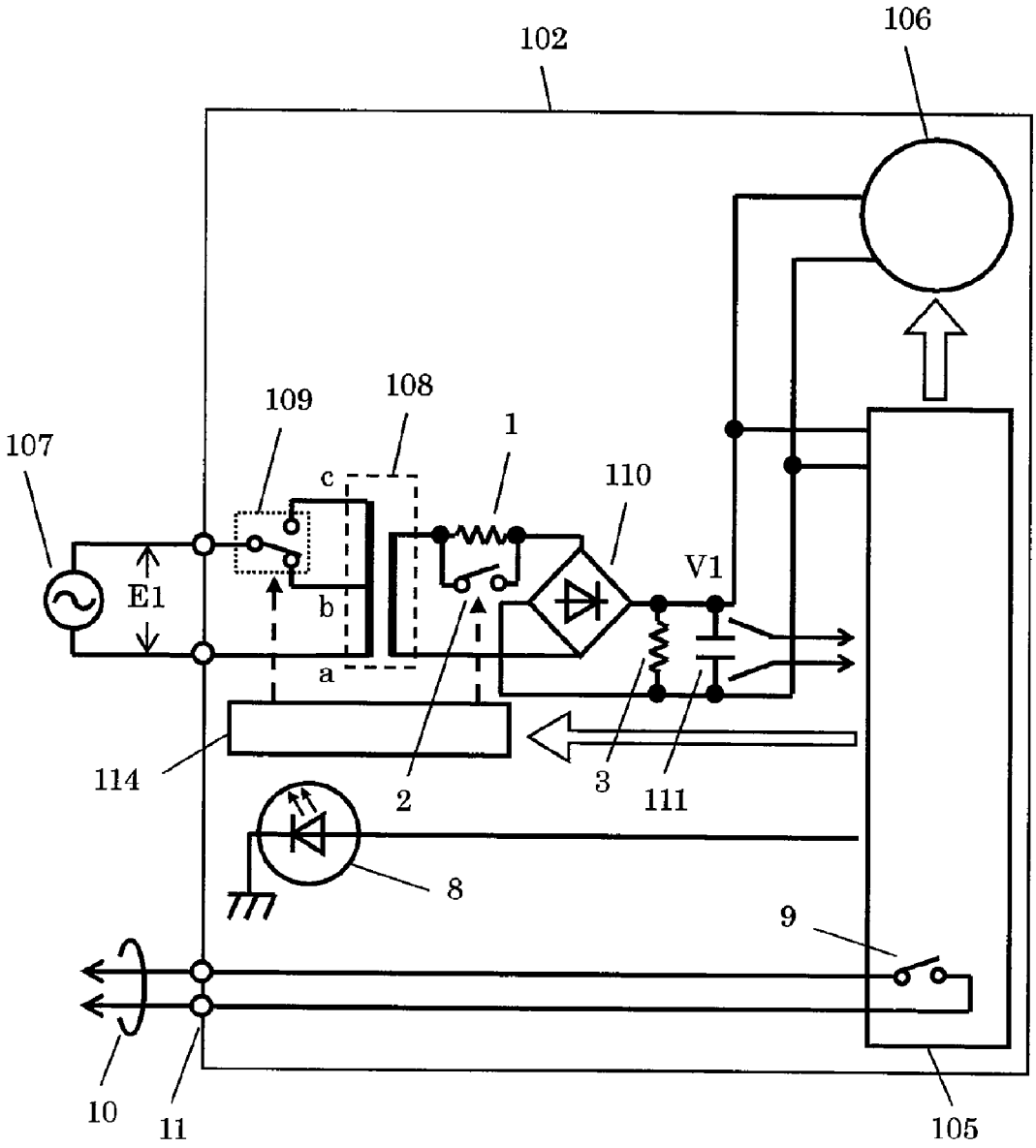
FIG. 10 is a block diagram of configuration of an apparatus for stabilizing power supply of heater housing box cooling apparatus in preferred embodiment 8 of the present invention.
Figure 11:
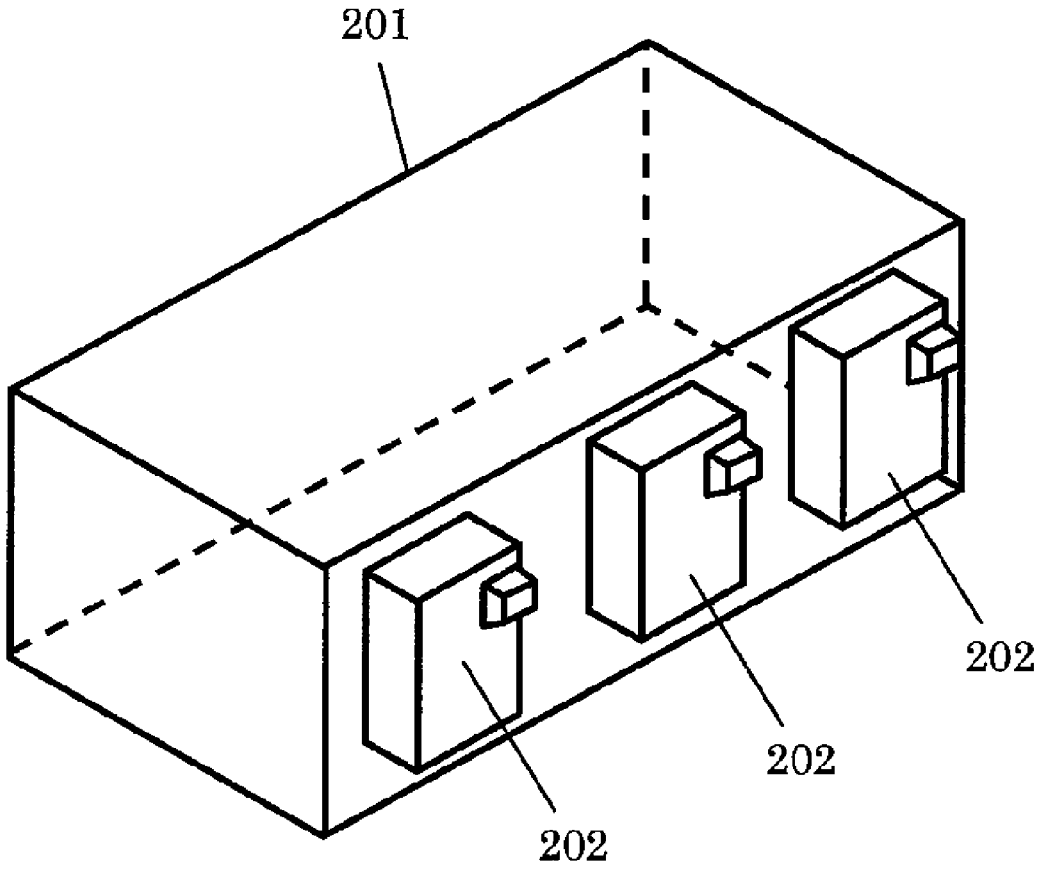
FIG. 11 is a structural diagram of a conventional heater housing box cooling apparatus.
Figure 12:
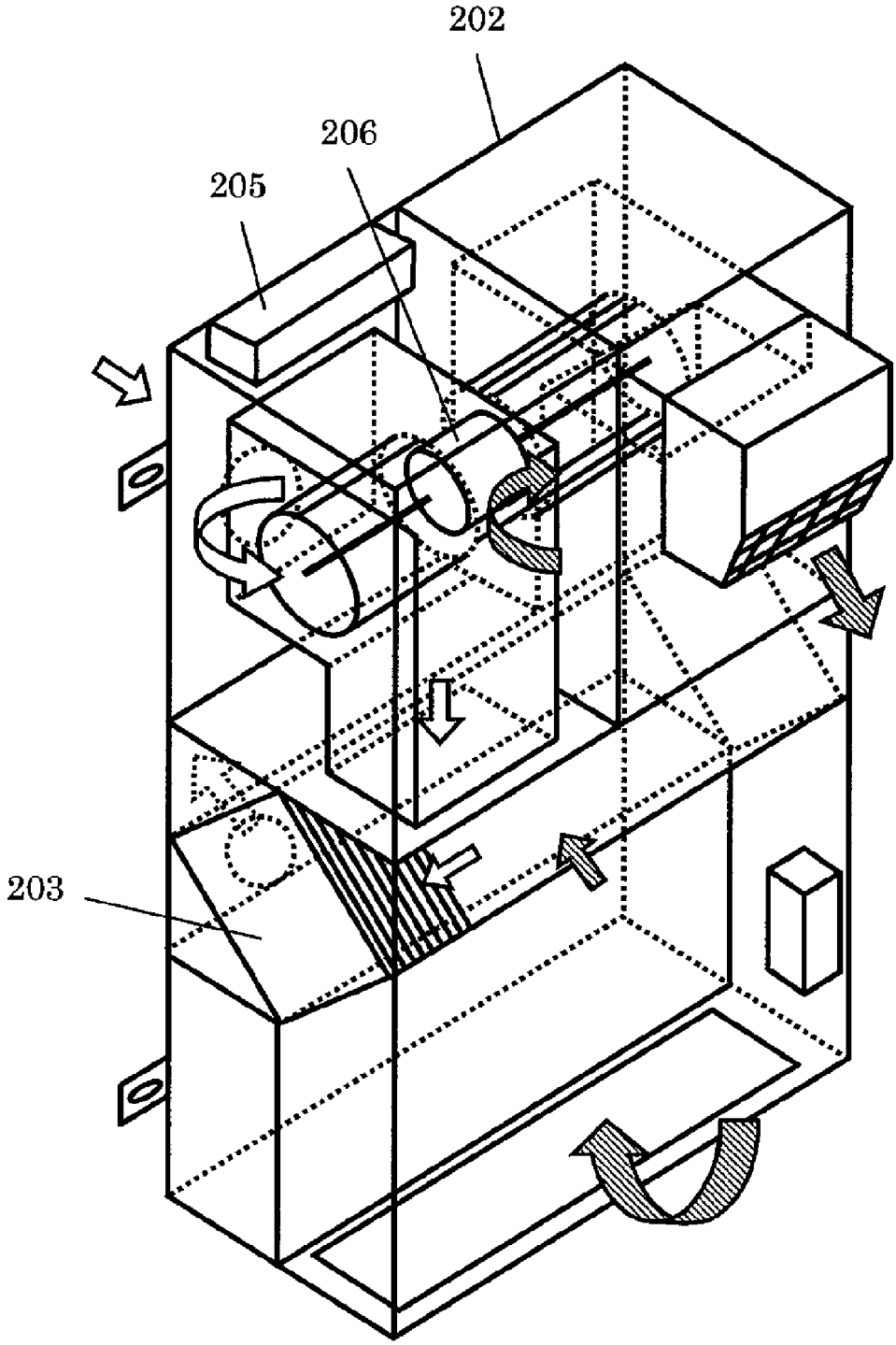
FIG. 12 is a structural diagram of configuration of the conventional heater housing box cooling apparatus.
Figure 13:
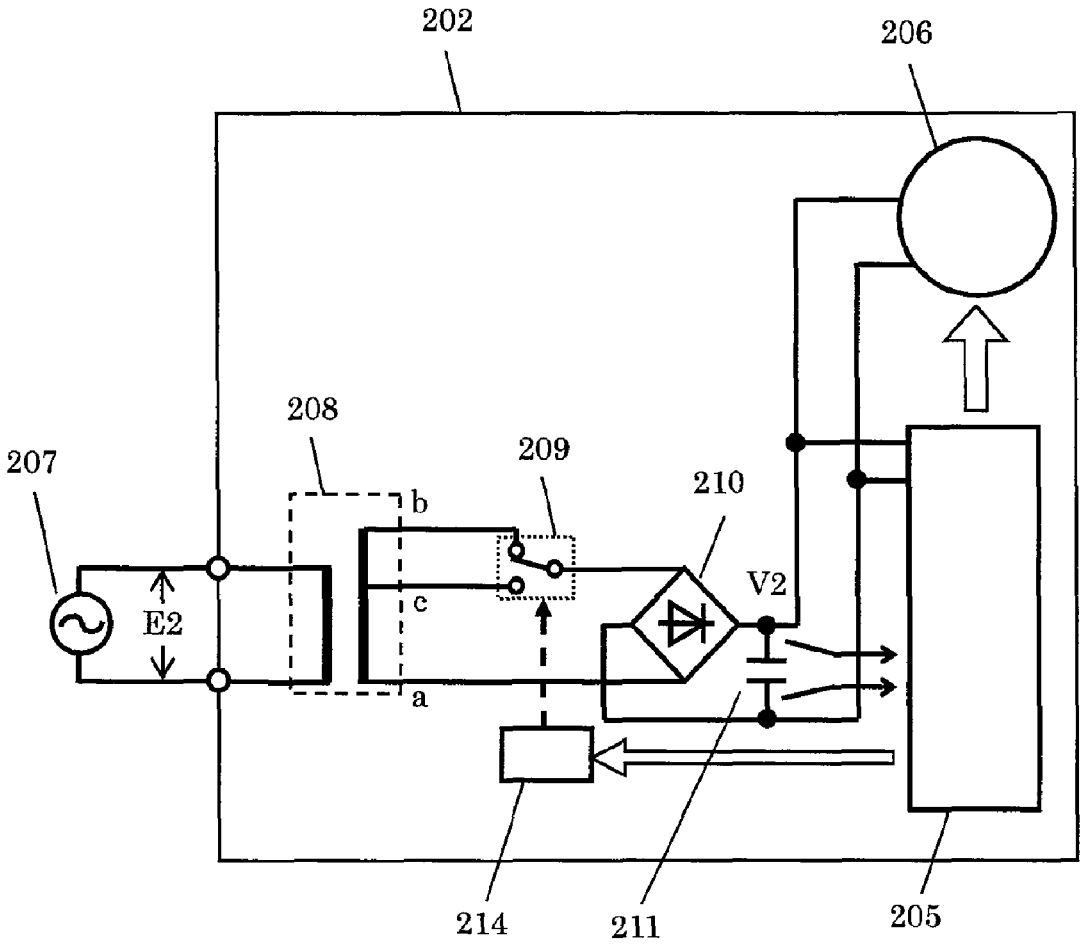
FIG. 13 is a block diagram of configuration of a conventional apparatus for stabilizing power supply of heater housing box cooling apparatus.
Figure 14:
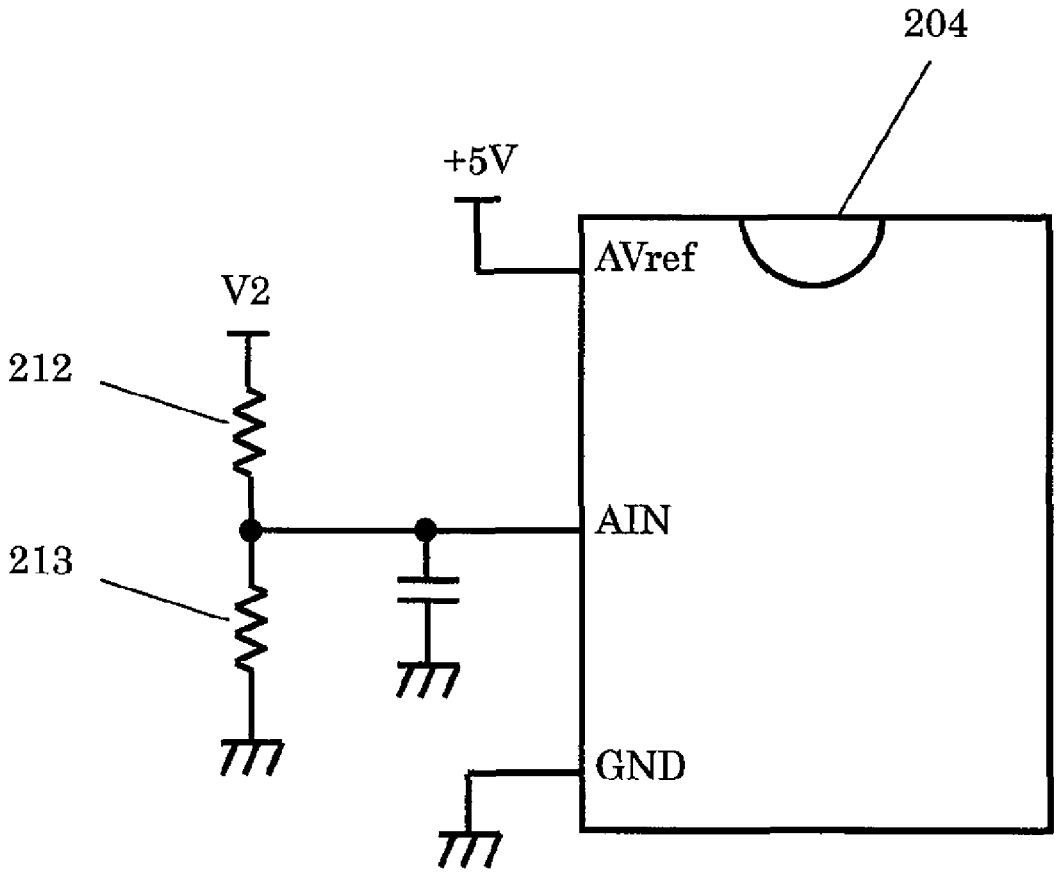
FIG. 14 is a circuit diagram of configuration of a conventional output voltage detector.
Figure 15:
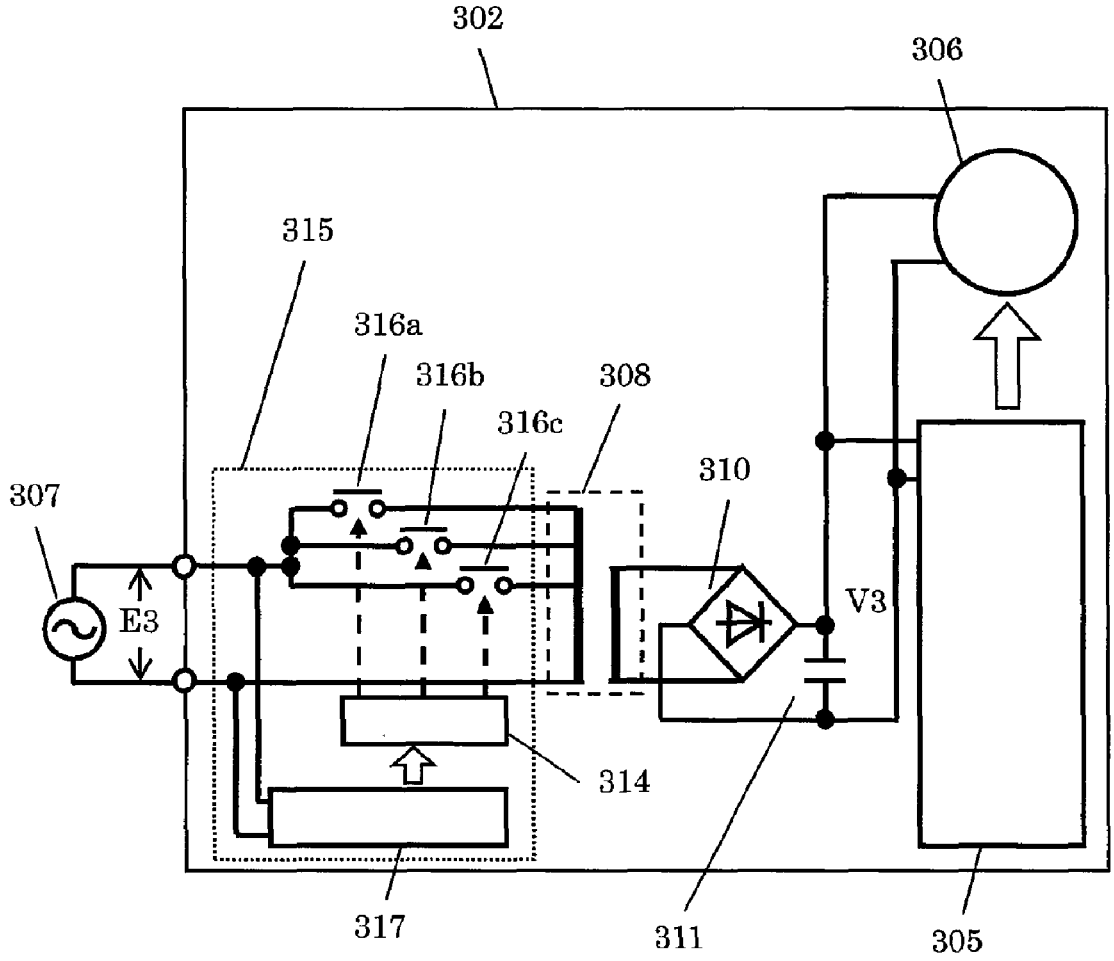
FIG. 15 is a block diagram of configuration of a conventional apparatus for stabilizing power supply of heater housing box cooling apparatus.
Figure 16:
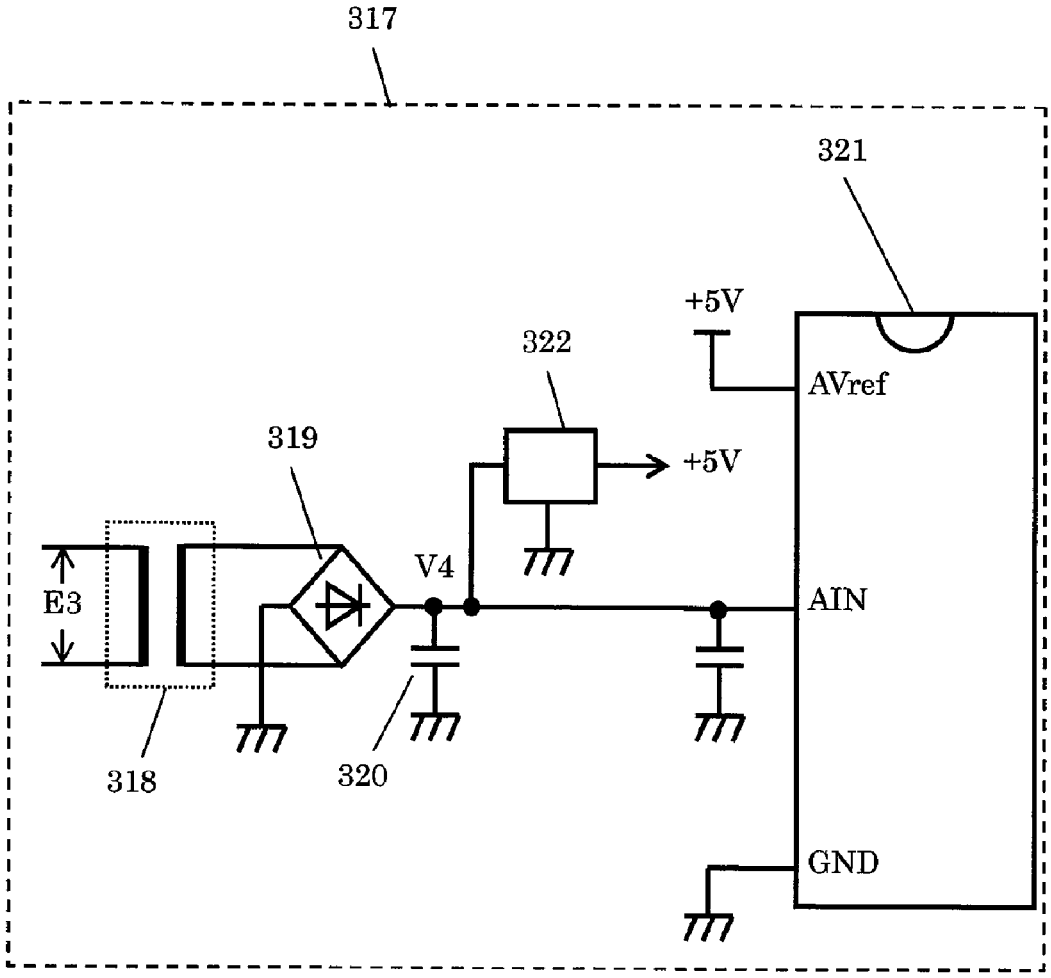
FIG. 16 is a circuit diagram of configuration of a conventional input voltage detector.

Same parts as in preferred embodiment 1 are identified with same reference numerals, and duplicate explanations are omitted. FIG. 10 is a block diagram of configuration of an apparatus for stabilizing power supply of heater housing box cooling apparatus in preferred embodiment 8 of the present invention.

As shown in FIG. 10, heater housing box cooling apparatus 102 includes light-emitting diode 8 as a luminous display part controlled in light emission by electronic controller 105. Electronic controller 105 includes abnormality alarm relay 9 of 1a type contact relay as a second switch element for generating a signal as an alarm unit for noticing abnormality alarm to outside, abnormality alarm signal transmission cable 10 for connecting this signal to outside of heater housing box cooling apparatus 102, and abnormality alarm signal transmission cable connection terminal block 11 as a connection port for this abnormality alarm signal transmission cable 10.

In this configuration, if first microcomputer 104 judges an overvoltage state, light emitting diode 8 is illuminated, and abnormality alarm relay 9 is turned on, and a closed circuit is formed by abnormality alarm signal transmission cable 10 to notice to outside (for example, service man or operator at a remote place), and thereby an overvoltage protective action can be noticed to outside.

In the foregoing preferred embodiments, in preferred embodiment 1, it is explained that the luminous display part or alarm part is provided during overvoltage protective action. However, in preferred embodiment 2 to preferred embodiment 7, the same action and effect are obtained, and the light-emitting diode is explained as luminous display part, but the same action and effect will be obtained by using seven-segment LED, or liquid crystal display panel.

INDUSTRIAL APPLICABILITY

By using a resistor provided at a primary side or a secondary side of a power transformer, and a switch element connected in parallel to this resistor, the alternating-current voltage can be easily controlled within an allowable voltage value range, and the present invention may be applied in a wide range of nominal alternating-current power supplied.

The invention claimed is:

1. An apparatus for stabilizing a power supply of a heater housing box cooling apparatus for cooling a heater housing box comprising: a power transformer for transforming an output voltage of an alternating-current power supply supplied from the heater housing box, a plurality of taps provided in a winding of the power transformer for controlling the transformed output voltage within an allowable voltage range, a tap changeover part for changing over the plurality of taps, an electronic controller including an output voltage detector for detecting the transformed output voltage, and a delay part for limiting a rise of the transformed output voltage when turning on the alternating-current power supply, wherein the electronic controller delays control of the tap changeover part until the transformed output voltage rises to an initial value responsive to the delay part limiting the rise of the transformed output voltage, the initial value being less than the allowable voltage range, and wherein a first resistor as the delay part is provided at a secondary side of the power transformer, and a switch element for lowering a resistance value of the first resistor in an ordinary operation after a delay action is connected in parallel with the first resistor.

2. The apparatus for stabilizing the power supply of the heater housing box cooling apparatus according to claim 1, wherein a rectifying and smoothing part for rectifying and smoothing the transformed output voltage and producing a direct-current voltage, and a second resistor for dividing the direct-current voltage produced from the rectifying and smoothing part together with the first resistor are provided between a positive pole and a negative pole of the direct-current voltage.

3. The apparatus for stabilizing the power supply of the heater housing box cooling apparatus according to claim 2, wherein the first resistor is provided between a rectifying element for composing an output part and the rectifying and smoothing part of the power transformer, and a capacitor.

4. The apparatus for stabilizing the power supply of the heater housing box cooling apparatus according to claim 1, wherein a first resistor as the delay part is provided at a primary side of the power transformer, and a switch element for lowering a resistance value of the first resistor in an ordinary operation after a delay action is connected in parallel with the first resistor.

5. The apparatus for stabilizing the power supply of the heater housing box cooling apparatus according to claim 4, wherein a third resistor for dividing an alternating-current voltage of the alternating-current power supply together with the first resistor is provided between the power transformer side of the first resistor and an opposite side phase of a phase of the alternating-current power supply connected with the first resistor.

6. An apparatus for stabilizing a power supply of a heater housing box cooling apparatus for cooling a heater housing box comprising: a power transformer for transforming an output voltage of an alternating-current power supply supplied from the heater housing box, a plurality of taps provided in a winding of the power transformer for controlling the transformed output voltage within an allowable voltage range, a tap changeover part for changing over the plurality of taps, an electronic controller including an output voltage detector for detecting the transformed output voltage, and a delay part for limiting a rise of the transformed output voltage when turning on the alternating-current power supply, wherein the electronic controller delays control of the tap changeover part until the transformed output voltage rises to an initial value responsive to the delay part limiting the rise of the transformed output voltage, the initial value being less than the allowable voltage range, and wherein a turn ratio of a primary winding and a secondary winding of the power transformer is set so that the output voltage of the power transformer when turning on the alternating-current power supply becomes a starting voltage of the electronic controller connected to the apparatus for stabilizing the power supply.

7. The apparatus for stabilizing the power supply of the heater housing box cooling apparatus according to any one of claims 1 to 5, wherein an overvoltage protective action part is provided for turning off the switch element connected in parallel to the first resistor when the output voltage of the alternating-current power supply is larger than a nominal value after turning on the alternating-current power supply.

8. The apparatus for stabilizing the power supply of the heater housing box cooling apparatus according to claim 7, wherein a luminous display part is provided for visual recognition of an operation of the overvoltage protective action part.

9. The apparatus for stabilizing the power supply of the heater housing box cooling apparatus according to claim 7, wherein a second switch element is provided for noticing the operation of the overvoltage protective action part.

10. The apparatus for stabilizing the power supply of the heater housing box cooling apparatus according to any one of claims 1 to 5, wherein the tap changeover part is connected to the plurality of taps provided in a primary winding of the power transformer and is operated depending on the transformed output voltage detected by the output voltage detector.

11. The apparatus for stabilizing the power supply of the heater housing box cooling apparatus according to any one of claims 1 to 5, wherein the tap changeover part is connected to the plurality of taps provided in a primary winding and a secondary winding of the power transformer and is operated depending on the transformed output voltage detected by the output voltage detector.

* * * * *